US010060432B2

(12) United States Patent
Pippes et al.

(10) Patent No.: US 10,060,432 B2
(45) Date of Patent: Aug. 28, 2018

(54) MOTOR-PUMP UNIT

(71) Applicant: Eckerle Industrie-Elektronik GmbH, Malsch (DE)

(72) Inventors: Reinhard Pippes, Bretten-Sprantal (DE); Dominik Ketterer, Ubstadt-Weiher (DE)

(73) Assignee: Eckerle Industrie-Elektronik GmbH, Malsch (DE)

( * ) Notice: Subject to any disclaimer, the term of this patent is extended or adjusted under 35 U.S.C. 154(b) by 477 days.

(21) Appl. No.: 14/664,349

(22) Filed: Mar. 20, 2015

(65) Prior Publication Data

US 2015/0267699 A1 Sep. 24, 2015

(30) Foreign Application Priority Data

Mar. 21, 2014 (DE) ..... 10 2014 103 959

(51) Int. Cl.
*F04C 29/02* (2006.01)
*F04C 2/10* (2006.01)
(Continued)

(52) U.S. Cl.
CPC ..... *F04C 11/008* (2013.01); *F04B 17/03* (2013.01); *F04B 53/04* (2013.01); *F04C 2/084* (2013.01);
(Continued)

(58) Field of Classification Search
CPC .. F04C 2/10; F04C 2/101; F04C 2/102; F04C 11/008; F04C 14/26; F04C 15/008;
(Continued)

(56) References Cited

U.S. PATENT DOCUMENTS 1,819,228 A 8/1931 Coates
2,190,246 A * 2/1940 Schirmer ..... F04C 2/101 417/366

(Continued)

FOREIGN PATENT DOCUMENTS

| | | |
|---|---|---|
| DE | 1553026 | 10/1969 |
| EP | 2128446 | 12/2009 |
| WO | 2013099505 | 7/2013 |

OTHER PUBLICATIONS

European Search Report in Corresponding European Application No. 15 158 367.1, dated Sep. 28, 2015.

*Primary Examiner* — Peter J Bertheaud
(74) *Attorney, Agent, or Firm* — Edell, Shapiro & Finnan, LLC

(57) ABSTRACT

A motor pump unit with a multipart housing comprises a reversible internal gear machine and an electric motor with a rotor and a stator, which is coupled to the internal gear machine via a shaft rotatably mounted in the housing. One shaft end extends from the internal gear machine axially through the rotor that is carried by the shaft. First and second connecting channel ends in the working chamber of the internal gear machine are connected via check valves in the housing to a leakage channel loop, which is fluidically connected to a leakage channel that is fluidically connected to the working chamber, and which has a shaft leakage channel extending axially through the shaft and a rotor leakage channel that is fluidically connected thereto and extends axially through the rotor and/or a gap leakage channel between the rotor and stator, which is fluidically connected to the shaft leakage channel.

20 Claims, 8 Drawing Sheets

(51) Int. Cl.

| | |
|---|---|
| ***F04C 11/00*** | (2006.01) |
| ***F04C 15/00*** | (2006.01) |
| ***F04C 2/08*** | (2006.01) |
| ***F04B 17/03*** | (2006.01) |
| ***F04B 53/04*** | (2006.01) |
| ***F04C 14/04*** | (2006.01) |

(52) U.S. Cl.
CPC ..... *F04C 2/101* (2013.01); *F04C 2/102* (2013.01); *F04C 14/04* (2013.01); *F04C 15/008* (2013.01); *F04C 15/0019* (2013.01); *F04C 15/0026* (2013.01); *F04C 15/0046* (2013.01); *F04C 15/0088* (2013.01); *F04C 15/0096* (2013.01); *F04C 29/023* (2013.01); *F04C 2240/603* (2013.01)

(58) Field of Classification Search
CPC .. F04C 29/023; F04C 29/045; F04C 2240/40; H02K 9/19
USPC ..... 417/366, 369, 370, 410.3, 410.4
See application file for complete search history.

(56) References Cited

U.S. PATENT DOCUMENTS

| | | | | |
|---|---|---|---|---|
| 2,469,820 | A | 5/1949 | Fuge | |
| 3,373,690 | A | 3/1968 | Unger | |
| 6,837,688 | B2 * | 1/2005 | Kimberlin | F04D 13/064 417/32 |
| 6,884,043 | B2 * | 4/2005 | Kimberlin | F04D 13/064 417/355 |
| 9,441,628 | B2 * | 9/2016 | Sakata | F04C 2/086 |

* cited by examiner

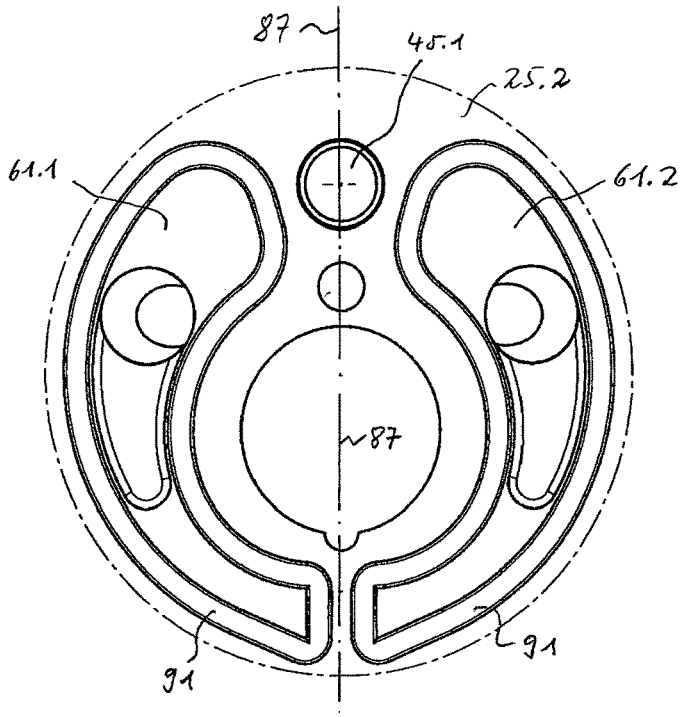
Fig. 7
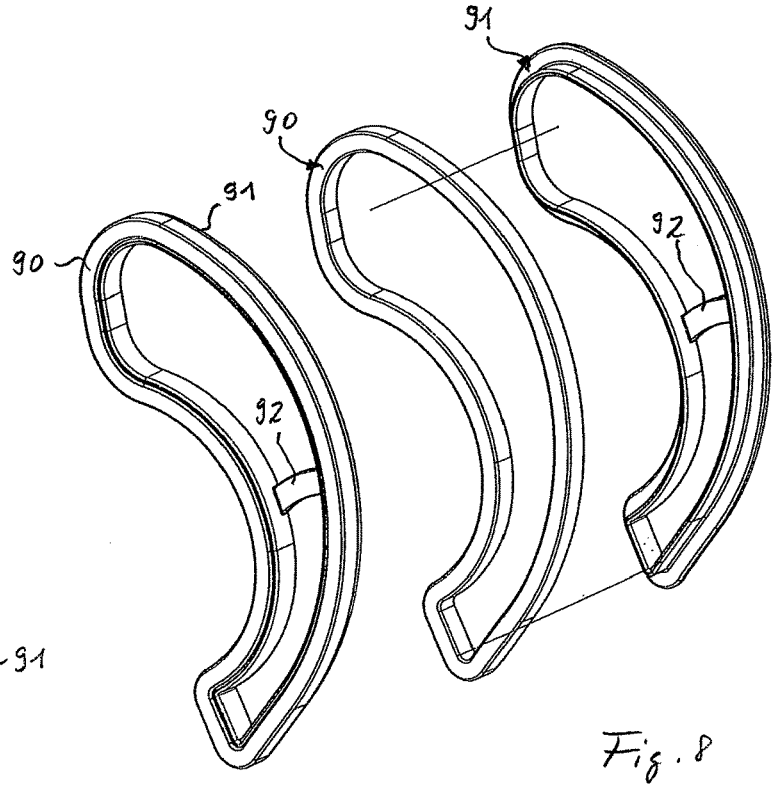
Fig. 8
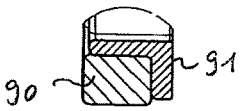
Fig. 10
Fig. 9

20
25
25.1
25.2
25.3
25.4
25.5
25.6
25.7
30
34.1
34.2
35
58.1
61.1
101.1
105.1
105.2
106
111
114
122.2
123
124
125
126
128
132
133
133.2
133.5
140
141
143.1
143.2
144.1
144.2
145.1
145.2
146.1
146.2
147
147.1
148
149
154.1
154.2
22.1
22.2
99

MOTOR-PUMP UNIT

CROSS REFERENCE TO RELATED APPLICATIONS

This application claims foreign priority under 35 U.S.C. § 119(a)-(d) to Application No. DE 102014103959.9 filed on Mar. 21, 2014, the entire contents of which are hereby incorporated by reference.

FIELD OF THE INVENTION

The invention relates to a motor pump unit comprising an internal gear machine for reverse operation and an electric motor, which is coupled via a shaft to the internal gear machine.

BACKGROUND

A motor pump unit can be used, for example, to drive a highly dynamic hydraulic axis.

The important features for such motor pump units are a high dynamic capacity, low noise and pulsation level, recoverability, long service life, freedom from leakage, long service and insensitivity to shock, contamination, water, in particular salt water and temperature, in particular cold.

Malfunction or even early total breakdown can occur over the operating time or during operation in the motor pump units known until now as a result of the design. These motor pump units are additionally comparatively complex and expensive to manufacture.

SUMMARY

It is the object of the invention to provide a motor pump unit of the above-named type, which is designed to be especially compact, can be operated for as long as possible without malfunction or has a longer service life, and should be cost effectively manufactured in particular with reference the stator and the housing parts that accommodate or delimited said stator, and wherein Preferably wherein additional advantageous possibilities for forced lubrication of a rotor or shaft bearing allocated with the electric motor exist.

This object is attained by means of the features of claim 1. The invention comprises accordingly a motor pump unit having a multipart housing, an internal gear machine for reverse operation and an electric motor with a rotor and a stator, said electric motor being coupled to the internal gear machine via at least one shaft, which is rotatably mounted in the housing around a shaft rotational axis, wherein the electric motor comprises a rotor, which can rotate around a rotor rotational axis in a housing part of the housing, and a stator, and wherein the internal gear machine comprises a working chamber that is delimited by at least two housing parts of the housing, and in which two gears are arranged, which are an externally toothed pinion having pinion teeth, and an internally toothed pinion having pinion teeth, which is eccentrically mounted with reference to the pinion, wherein the pinion teeth of the pinion teeth of the pinions mesh in a tooth engagement area with the pinion teeth of the pinion teeth of the pinion, and wherein the pinion is rotatably mounted around a pinion rotational axis and the pinion is rotatably mounted around a pinion rotational axis that arranged parallel to the pinion rotational axis, and wherein the hollow gear rotational axis and the pinion rotational axis extend in an axial direction, and wherein the internal gear machine operates as an internal gear pump and in a first operating direction, in which the pinion and the hollow gear rotate in a first rotational direction, the working chamber is preferably pressurized with fluid high pressure of a fluid pressurizing medium in a first high pressure area and is fluidically connected to a first connecting channel, preferably wherein a first low pressure area, which is fluidically connected to a second connecting channel, is formed in another area of the working chamber and the working chamber is preferably pressurized in a second high pressure area with fluid high pressure of the fluid pressurizing medium, which is fluidically connected to a second connecting channel, in a second operating direction, in which the pinion and the hollow gear rotate in a second rotational direction opposite to the first rotational direction preferably wherein, a second low pressure area is formed in another area of the working chamber, which is fluidically connected to the first connecting channel, and wherein at least one leakage channel is fluidically connected to the working chamber 24 for drainage of a leakage fluid consisting of the fluid pressurizing medium that forms during the operation of the internal gear machine in a housing part of the housing parts that delimit the working chamber, in particular when a radial and/or axial gap seal is used, preferably by means of radial sealing segments and/or at least one axial sealing plate. The shaft extends with one shaft end from the pinion in axial direction through the rotator carried by the shaft. The first connecting channel and the second connecting channel are connected via check valves arranged in the housing or in a housing part of the housing that delimits the working chamber to a leakage channel loop that is fluidically connected to the at least one leakage channel and extends into at least one area of a rotor end of the rotor that extends away from the pinion, and which has a shaft leakage channel that extends in axial direction in the shaft or through the shaft, and at least one rotor leakage channel that is fluidically connected to the shaft leakage channel, preferably in a radial separation from the shaft leakage channel, and extends in axial direction in the rotor or through the rotor, and/or a gap leakage channel that is fluidically connected to the shaft leakage channel and extends in axial direction, which is formed between the rotor and the stator when observed in radial direction. The check valves block in one fluid flow direction from the leakage channel loop, preferably open to the specific active low pressure area of the working chamber, and block in a counter direction or opposed fluid flow direction, preferably from the respectively active high pressure of the working chamber to the leakage channel loop, so that during operation of the internal gear machine, the leakage fluid, with the exception of a leakage fluid portion, flows from the at least one leakage channel through the leakage channel loop into the working chamber, and preferably from there basically into the connecting channel allocated to the respectively active low pressure area.

According to a preferred embodiment, it can be provided that a sickle-shaped free space is formed between the pinion and the hollow gear. A one-piece or multipart filler can be arranged in the sickle-shaped free space.

According to a special preferred embodiment, it can be provided that a sickle-shaped free space is formed in which one multipart filler piece, which comprises several radial sealing segments that are movable relative to one another in the radial direction, is arranged between the pinion and the hollow gear to radially seal a high pressure area of the working chamber, of which a first radial seal segment forms a pinion segment that can abut or abuts against pinion teeth of the pinion teeth of the pinion, and of which a second radial sealing segment forms a pinion segment that can abut or abuts against pinion teeth of the pinion teeth of the pinion. An advantageous radial compensation can be achieved by means of these measures.

Alternatively or in addition to the features mentioned in the paragraph above, it can be provided that at least one axial sealing plate that can be moved in axial direction is arranged between axial faces of the gears and at least one housing part of the housing to axially seal the high pressure area of the working chamber. An advantageous axial compensation can be achieved by means of these measures.

According to one embodiment, it can be provided that a radial gap is formed between a pinion segment internal surface that faces radially outward toward the pinion segment and an internal surface of the pinion segment lying opposite and facing radially inward toward the pinion segment.

According to a further development it can be provided that the at least one leakage channel is directly fluidically connected to the shaft leakage channel of the leakage channel loop, and that the at least one rotor leakage channel of the leakage channel loop is directly fluidically connected to a connecting channel or connecting space arranged in a housing part of the housing or in the housing part of the housing containing at least one leakage channel, so that the leakage fluid flows either from the at least one leakage channel through the shaft leakage channel and in and through the at least one rotor leakage channel of the leakage channel loop, and from there into the connecting channel or into the connecting space, or vice versa during operation of the internal gear machine, or that the at least one leakage channel is directly fluidically connected to the at least one rotor leakage channel of the leakage channel loop, and that the at least one shaft leakage channel of the leakage channel loop is directly fluidically connected to a connecting channel or connecting space arranged in a housing part of the housing or in the housing part of the housing containing the at least one leakage channel, so that the leakage fluid flows either from the at least one leakage channel through the at least one rotor leakage channel and in and through the shaft leakage channel of the leakage channel loop and from there into the connecting channel or into the connecting space, or vice versa during operation of the internal gear pump.

In accordance with an especially preferred embodiment, it can be provided that a first return flow channel and a second return flow change are arranged, which each end at the one side of the connecting channel or the connecting space in a housing part of the housing, and on the other side the working chamber, preferably in an outlet area located opposite to an outlet of the respective connecting channel to the working chamber, between the working chamber and the connecting channel or the connecting space, wherein the first return flow channel contains a first check valve of the check valves, and wherein the second return flow channel contains a second check valve of the check valves, so that the leakage fluid flows through the leakage channel loop, preferably from the leakage channel through the shaft leakage channel and through the at least one rotor leakage channel of the leakage channel loop, or vice versa, in and through the connecting channel or the connecting space and from there either in and through the first return flow channel via the first check valve into the working chamber or in and through the second return flow channel via the second check valve into the working chamber during operation of the internal gear machine.

Here it can be provided that a first channel portion of the first return flow channel that ends in the working chamber and the first connecting channel extend in the axial direction, preferably coaxially to one another, and that a second channel portion of the second return flow channel and the second connecting channel extend in the axial direction, preferably coaxially to one another.

According to a preferred embodiment, it can be provided that the shaft leakage channel is an axial bore with a longitudinal axis that is arranged coaxially to the rotor rotational axis and/or coaxially to the shaft rotational axis. It can be provided in addition or as an alternative that this is an axial recess for the at least one rotor leakage channel, with the recess longitudinal axis arranged parallel to the pinion rotational axis and/or parallel to the shaft rotational axis.

According to an especially preferred embodiment, it can be provided that the rotor contains a plurality of rotor leakage channels extending in axial direction through the rotor, which rotor leakage channels are each fluidically connected at one end to the shaft leakage channel and at the other end to the working chamber and/or to the connecting channel or to the connecting space.

According to a preferred development, it can be provided that the at least one rotor leakage channel extends through the rotor and is open to the rotor ends of the rotor facing in axial direction away from one another, or that the rotor leakage channels extend through the rotor and are open to the rotor ends of the rotor facing in the axial direction away from one another.

According to an especially preferred embodiment, it can be provided that the shaft has at least one radial recess, which ends at one end in the shaft leakage channel, and is open radially outwardly at the other end and is arranged in the area of the at least one leakage channel that is open to the shaft, preferably formed as an annular space, for receiving the leakage fluid, so that the leakage fluid flows from the at least one leakage channel, preferably directly into the shaft leakage channel, during operation of the internal gear machine.

According to an especially advantageous embodiment, it can be provided that the shaft is mounted by means of a rotor bearing of the rotor on a housing part of the housing allocated to the electric motor in the area of its shaft end that is allocated to the rotor or at its shaft end allocated to the rotor, so that it can rotate around its shaft rotational axis, and that the shaft leakage channel of the shaft and the at least one rotor leakage channel of the rotor are fluidically connected to a bearing gap of the rotor bearing, so that the leakage of fluid flows to the bearing gap or through the bearing gap of the rotor bearing during operation of the internal gear machine. The rotor bearing can preferably be a roller bearing or a ball bearing.

According to an advantageous development, it can be provided that the shaft has at least one radial recess which is arranged in the area of the rotor bearing and which ends at one in the shaft leakage channel and is radially outwardly open at the other end to a first connecting channel that is fluidically connected to the bearing gap of the rotor-bearing or a connecting space preferably designed as an annular area, which is fluidically connected to the at least one rotor leakage channel or empties into the at least one rotor leakage channel, so that during operation of the internal gear machine, the leakage fluid flows from the shaft leakage channel into the connecting channel that is fluidically connected to the bearing gap of the rotor bearing or into the connecting space preferably configured as an annular area, and from there to the at least one rotor leakage channel, or vice versa.

According to a preferred embodiment, it can be provided that a bearing mounting and/or sensor element is secured to the shaft in the area of the shaft end allocated to the rotor, so that the rotor bearing is secured to the shaft and/or contains a sensor, preferably a speed sensor.

According to an advantageous development, it can be provided that the shaft leakage channel is closed in the area of the shaft end of the shaft allocated to the rotor by means of the bearing mounting and/or sensor element.

According to a further improvement, it can be provided that the bearing mounting and/or sensor element is a bearing mounting screw and/or a sensor screw, and is screwed to the shaft.

The bearing mounting and/or sensor element can preferably be made from non-magnetic material and the sensor can generate or generates magnetic signals.

According to a very especially advantageous embodiment, it can be provided that an axial recess that is fluidically connected to the shaft leakage channel is arranged in the bearing mounting and/or sensor element and empties in a radial recess of the bearing mounting and/or sensor element and is radially outwardly open to a or the connecting channel that is fluidically connected to the bearing gap of the rotor bearing or is open to the connecting space, which is preferably configured as an annular area that is arranged on the side of the rotor bearing that faces away from the pinion, so that the leakage fluid flows from the shaft leakage channel via the axial recess and the radial recess of the bearing mounting and/or sensor element and via the connecting channel or connecting space through the bearing gap of the rotor bearing into the at least one rotor leakage channel, or vice a versa during operation of the internal gear machine.

According to a very especially preferred embodiment, it can be provided that a sealing tube made from a non-magnetic material is arranged between the rotor and the stator, which has a length when viewed in the axial direction that extends in the axial direction substantially over the entire length of the stator, which is mounted on the stator, and is sealed tight to the stator to prevent penetration of the fluid pressurizing medium or leakage fluid.

It can be provided here according to a further improvement that the sealing tube is encapsulated with the stator, including its coils or phasing lines and a housing part of the housing that receives the stator, as a unit sealed against the penetration of fluid pressurizing medium or leakage fluid by means of a non-magnetic sealing compound.

According to a preferred development, it can be provided that the gap leakage channel is configured between the sealing tube and the rotor when viewed in the radial direction.

According to a further improvement, it can be provided that the gap leakage channel is an annular gap leakage channel.

According to an especially preferred embodiment, it can be provided that the shaft is a one-piece motor pump shaft and/or is produced from a single piece, on which the rotor is torque-proof mounted, preferably friction locked, especially by pressing or shrink fitting, and to which the pinion is torque-proof mounted, preferably form lockingly mounted, in particular releasably mounted.

According to an especially advantageous embodiment, it can be provided that the electric motor is a brushless DC motor (EC motor).

It is understood that the above features and measures can be combined as desired within the scope of practicability of the invention.

BRIEF DESCRIPTION OF THE DRAWINGS

Further features, advantages, and viewpoints of the invention arise from the claims and the drawings as well as from the following description, in which a preferred exemplary embodiment of the invention is described with reference to the figures.

In the figures:

FIG. 7 shows a plan view of a housing part of the housing of the internal gear machine lying opposite the axial sealing plate on its side that is turned away from the teeth;

FIG. 8 shows a perspective view of an arrangement of a sealing ring and a support ring for the sealing ring in exploded view;

FIG. 9 shows a perspective view of an arrangement in which the support ring and the sealing ring are plugged together in an installation position;

FIG. 10 shows an enlarged section of a cross section of the arrangement in accordance with FIG. 9 along section lines 10-10;

DETAILED DESCRIPTION

Figure 1:
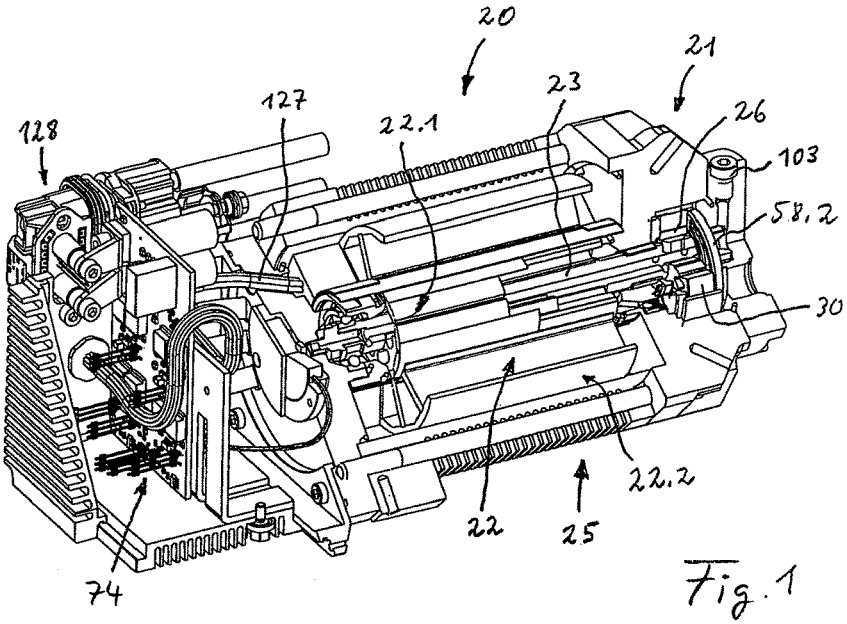
FIG. 1 shows a perspective view of a motor pump unit according to the invention.

The motor pump unit 20 comprises an internal gear machine 21 for reverse operation, an electric motor 22 and integrated electronics 74 in particular for speed control. The electric motor 22 comprises a rotor 22.1 and a stator 22.2. The rotor 22.1 that can rotate relative to the stator 22.2 around a rotor rotational axis 34.1 is torque-proof connected to a shaft 23 that can rotate around a shaft rotational axis 35. The rotor 22.1 is coupled via the shaft 23 to the gear mechanism of the internal gear machine 21. The shaft 23 is preferably a joint one-piece motor pump shaft. The motor pump shaft 23 is rotatably mounted around a shaft rotational axis 35 in the housing 25. The motor pump unit 20 can preferably be used to drive the highly dynamic hydraulic axis, which is not shown in the figures.

Figure 3:
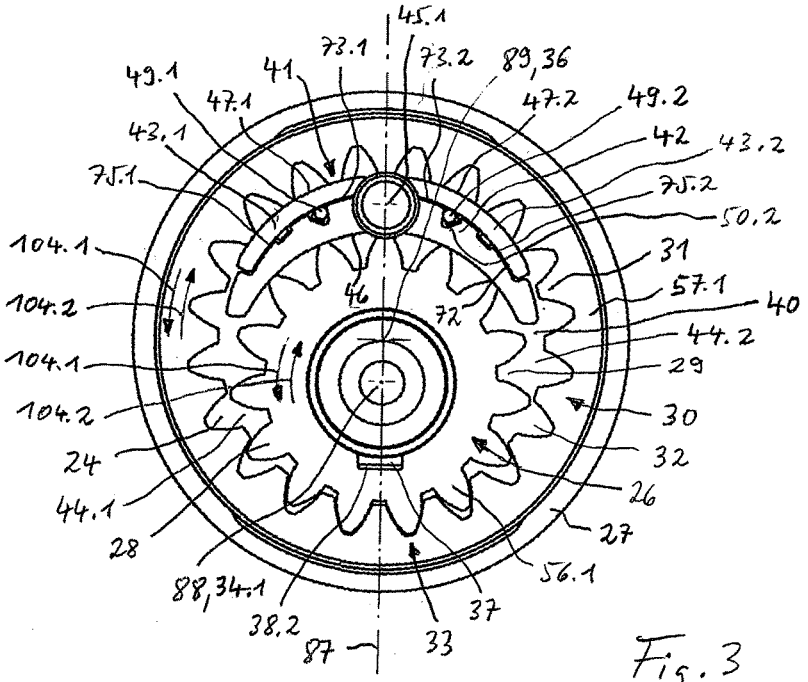
FIG. 3 shows a cross section of the internal gear machine of the motor pump unit along section lines 3-3 in FIG. 2.

The motor pump unit 20 comprises a multipart housing 25 that contains both the electric motor 22 and the internal gear machine 10. In the exemplary embodiment shown, both the rotor 22.1 and the stator 22.2 are arranged in a tubular housing part 25.3 of the housing 25 allocated to the motor 22. It is understood, however, that the stator could also form a component of the housing part of the housing of the motor pump unit or could be configured as the housing part of the housing of the motor pump unit. The internal gear machine 21 is a hydraulic machine in the form of a compensated four-quadrant internal gear machine 21. The motor pump unit 20 is preferably used in a closed hydraulic system. The motor pump unit 20 is marked by high dynamics, low noise and pulsation, recoverability, a long service life, absolute leak tightness, lifetime filling of the system, shock resistance, and resistance to dirt, water and particularly saltwater, and temperature, in particular cold. For this purpose, the motor pump unit 20 in particular has the following construction characteristics:

Internal Gear Machine:

The internal gear machine 21 is a hydraulic pump in the form of an internal gear pump with axial and radial sealing compensation. The internal gear machine 21 comprises a working chamber 24 that is preferably delimited by two housing parts 25.1 and 25.2 of the housing 25 of the motor pump unit 20. Two pinions 26 and 30 are arranged in the housing 25 or in the working chamber 24. They are an externally toothed pinion 26 having pinion teeth 28 and an internally toothed hollow gear 30 having hollow gear teeth 31. The hollow gear 30 is eccentrically mounted in a bearing ring 27 with respect to the pinion 26. The bearing ring 27 is torque-proof connected, preferable pressed into the housing part 25.2 of the housing 25. The hollow gear 30 is arranged in such a way that the hollow gear teeth of the hollow gear teeth 31 of the hollow gear 30 engage in the pinion teeth of the pinion teeth 28 of the pinion 26 in a tooth engagement area 33. The pinion 26 is rotatably mounted around a pinion rotational axis 34.2. The pinion rotational axis 34.2 is arranged coaxially to the shaft rotational axis 35 of the shaft 23. The hollow gear 30 is rotatably mounted around a hollow gear rotational axis 36. The rotational directions of the pinion 26 and the hollow gear 30 are the same. This means that if the pinion 26 rotates clockwise, then the hollow gear 30 necessarily also rotates clockwise. The pinion 26 is preferably releasably connected to the shaft 23, for example via a feather key 37, which engages in the matching grooves 38.1 and 38.2 of both the shaft 23 and the pinion 26 in a positive locking manner (see FIG. 3). Hence the pinion 26 and the shaft 23 are rotatably connected to one another in a positive locking manner. The hollow gear rotational axis 36 and the pinion rotational axis 34.2 extend in an axial direction 39 parallel to one another.

A sickle-shaped free space 40 of the working chamber 24 is formed between the pinion 26 and the hollow gear 30. A multipart, sickle-shaped filler element 41 is arranged in the free space 40. The filler element 41 comprises several radial sealing segments 42; 43.1 and 43.2, which are movable relative to one another in the radial direction for radially sealing the "active" pressure buildup area 44.1, 44.2 of the working chamber 24, which depends on the rotational direction 104.1, 104.2. The high pressure area 44.1, 44.2 is allocated to that area of the working chamber 24, which proceeding from a high pressure area of the working chamber 24, which roughly corresponds for operation of the internal gear machine 21 to that area in which the teeth 28, 31 of the gears 26, 30 reach the filler element 41 or the area of the filler element 41, in which at least one, preferably two retaining pin(s) or retaining bolts 41.5, 45.2 are arranged for the filler element 41 or for its radial sealing segments 42; 43.1, 43.2 when viewed in the particular rotational direction 104.1, 104.2 of the pinion 26 or hollow gear 30, extends to the tooth engagement area 33, in which the teeth 28, 31 of the gears 26, 30 mesh with one another. The particular active high pressure area 44.1, 44.2 is shaped as a half sickle or pocket. When the internal gear pump 21 rotates in its first operating direction, in which the pinion 26 an the hollow gear 30 rotate in their first rotational direction 104.1, the fluid high pressure forms in a first area 44.1 of the working chamber 24, in which this the active first high pressure area 44.1. A fluid low pressure is formed opposite thereto in the second area 44.2 of the working chamber. When the internal gear pump 21 rotates in its second operating direction opposite to the first operating direction, in which the pinion 26 and the hollow gear 30 thus rotate in their second rotational direction 104.2 in the opposite direction to the first rotational direction 104.1, a fluid high pressure forms in the second area 44.2 of the working chamber 24, wherein this is the active second high pressure area 44.2. A fluid low pressure is formed opposite thereto in the first area 44.1 of the working chamber. A first connecting channel 105.1 ends in said first area 44.1 of the working chamber 24 and a second connecting channel 105.2 ends in said second area 44.2 of the working chamber (refer to FIG. 12). Thus, when the internal gear pump 21 rotates in its first operating direction 104.1, the first working channel 105.1 is or will be pressurized by the fluid high pressure, and when the internal gear pump 21 rotates in its second operating direction 104.2, the second working channel 105.2 is or will be pressurized by the fluid high pressure of the fluid pressurizing medium. The first connecting channel 105.2 and the second connecting channel 105 preferably extend in the axial direction 39 parallel to one another.

The radial sealing segments 42; 43.1, 43.2 comprise a first radial sealing segment that forms a pinion segment 42, which can be called a segment carrier and can be mounted or is mounted on the pinion teeth of the pinion teeth 28 of pinion 26. The pinion segment 42 is configured as one piece and made from one piece, for example, by milling.

The radial sealing segments 42; 43.1, 43.2 comprise in addition at least one second radial sealing segment that forms a pinion segment 43.1, 43.2 and that can be mounted or is mounted on the hollow gear teeth of the hollow gear teeth 31 of the hollow gear 30. The preferred exemplary embodiment shown in the figures has two separate hollow gear segments 43.1 and 43.2, of which each hollow gear segment 43.1, 43.2 can be mounted or is mounted on the pinion teeth of the hollow gear teeth 31 of the hollow gear 30. The pinion segment 42 in the area of each hollow gear segment 43.1, 43.2 has an inner surface 72 that faces radially outward toward the particular hollow gear segment 43.1, 43.2. Each hollow gear segment 43.1, 43.2 has an inner surface 73.1, 73.2 facing radially inward toward the pinion segment 42 and lying opposite to the allocated inner surface 72 of the pinion segment 42. A radial gap 75.1, 75.2 is formed between the inner surface 72 of the pinion segment 42 and the inner surface 73.1, 73.2 of the particular hollow gear segment 43.1, 43.2. When the internal gear machine 21 is in operation, the pressurizing medium, preferably hydraulic fluid, reaches from the active pressure area 44.1, 44.2 allocated to the current rotational direction of the pinion 26 and the hollow gear 30 into said radial gap 75.1, 75.2 or into the corresponding space, which is also called the compensation area. In this way—depending on the rotational direction of the pinion 26 in the hollow gear 30—one of the two hollow gear segments 43.1, 43.2, namely the hollow gear segment 43.1, 43.2 allocated to the current or active high pressure area 44.1, 44.2, which can be designated as an active pinion segment, and the pinion segment 42 are pressed away or apart from one another, so that the pinion segment 42 is pushed with an outer surface 46 in a sealing manner against the tooth heads of the pinion teeth of the pinion teeth 28 of the pinion 26, and in addition the active hollow gear segment 43.1, 43.2 is pushed with an outer surface 47.1, 47.2 in a sealing manner against the tooth heads of the pinion teeth of the hollow gear teeth 31 of the hollow gear 30, so that the said radial gap 75.1, 75.2 is radially compensated in this manner. In this regard, one speaks of radial compensation or of a radially compensated internal gear machine 21.

In the exemplary embodiment shown, the hollow gear segment 43.1, 43.2 has two sealing roller grooves 48.1, 48.2 that extend in the axial direction 39. Each sealing roller groove 48.1, 48.2 is open toward its axial ends that face mutually away from each other. In each sealing roller groove 48.1, 48.2 is arranged a movable sealing roller 49.1, 49.2, which can be moved in radial direction relative to the pinion segment 42 and the respectively allocated hollow gear segment 43.1, 43.2 to seal the radial gap 75.1, 75.2 between the pinion segment 42 and the respective hollow gear segment 43.1, 43.2. In each sealing roller groove 48.1, 48.2 is arranged a preloaded sealing roller spring 50.1, 50.2, preferably a leaf spring. Each sealing roller spring 50.1, 50.2 is supported on one side by a groove base of the allocated sealing roller groove 48.1, 48.2 and on the other side on the allocated sealing roller 49.1, 49.2. In this way, each sealing roller 49.1, 49.2 is pressed against the sealing surface of the sealing roller groove 48.1, 48.2 of the pinion segment 42 as well as against a sealing surface of the specifically allocated hollow gear segment 43.1, 43.2 even in a pressure-free state or if the internal gear machine 21 is not in operation.

The pinion segment 42 furthermore has two segment spring grooves 51.1, 51.2 that extend in axial direction 39. Each segment spring groove 51.1, 51.2 is open in the direction to their axial ends that point away from one another. Each segment spring groove 51.1, 51.2 receives a preloaded spring 52.2, 52.2, preferably a leaf spring. Each segment spring groove 51.1, 51.2 is displaced at a peripheral distance or by a peripheral angle with respect to the allocated sealing roller groove 48.1, 48.2 in peripheral direction, and in the direction of a pinion segment end 53.1, 53.2 of the pinion segment 42 allocated to the high pressure area 44.1, 44.2 depending on the rotational direction. The allocated hollow gear segment 43.1, 43.2 and the pinion segment 42 are pressed in the radial direction away from or apart from one another by means of this spring 52.1, 52.2 in such a way that the pinion segment 42 sealing abuts with a radially inwardly directed outer surface 46 against hollow gear teeth of the hollow gear teeth 31 of the hollow gear 30, and that the hollow gear segment 43.1, 43.2 sealingly abuts with an radially outwardly facing outer surface 47.1, 47.2, which faces away from the outer surface 46 of the pinion segment 42, against the hollow gear teeth of the hollow gear teeth 31 of the hollow gear 30.

The pinion segment 42 is designed as a segment carrier for the particular hollow gear segment 43.1, 43.2 and has a stop 54.1, 54.2, which can also be called a stop pocket, for each hollow gear segment 43.1, 43.2. Each stop 54.1, 54.2 has stop surface 55.1, 55.2 that extend in axial direction 39 as well as radially outward to the hollow gear 30, for support of the particular hollow gear segment 43.1, 43.2 against a retraction of the respective hollow gear segment 43.1, 43.2 during operation of the internal gear machine 21 into the tooth engagement area 33. Each stop 54.1, 54.2 is arranged offset with its stop surface 55.1, 55.2 at a peripheral distance or by a peripheral angle with respect to the respective segment spring groove 51.1, 51.2 in a peripheral direction in the direction of the pinion segment 53.1, 53.2 of the pinion segment 42 allocated to the active high pressure area 44.1, 44.2, which is dependent on the rotational direction.

Two axial sealing plates 58.1, 58.2 that can be moved in axial direction 39 are provided in the shown exemplary embodiment for axial compensation of the respective axial gap between the faces 56.1, 56.2; 57.1, 57.2 of the gears 26, 30 that face in the same direction or are allocated to the same sides of the gears 26, 30 and the respective housing part 25.1, 25.2. The purpose of said axial sealing plates is to seal the high pressure area 44.1, 44.2 of the working chamber 24, which is dependent on the rotational direction of the gears 26, 30. The axial sealing plates 58.1, 58.2 can also be called axial washers. It is understood that only one single axial washer can be provided. The or each axial washer 58.1, 58.2 is arranged between the allocated faces 56.1, 56.2; 57.1, 57.2 of the gears 26, 30 and a housing part 25.1, 25.2 of the housing 25.

The or each axial sealing washer 58.1, 58.2 is pressed by means of the pressurizing medium under high pressure with its particular inner surface 59.1, 60.1 against the respectively allocated faces 56.1, 56.2; 57.1, 57.2 of the pinion 26 and the hollow gear 30 during operation of the internal gear machine 21. The so-called pressure fields 61.1, 61.2, which can also be called axial fields (see FIG. 7) are provided for this purpose. The pressure fields 61.1, 61.2 form control fields. The pressure fields 61.1, 61.2 are provided in the form of recesses in the respectively allocated housing part 25.1, 25.2 of the housing 25 in this exemplary embodiment. It is understood, however, that the pressure fields or a pressure field allocated to an axial sealing plate can also be provided in the form of a recess in the axial sealing plate or in the particular axial sealing plate. The or each pressure field 61.1, 61.2 is configured in the shape of a pocket.

Figure 4:
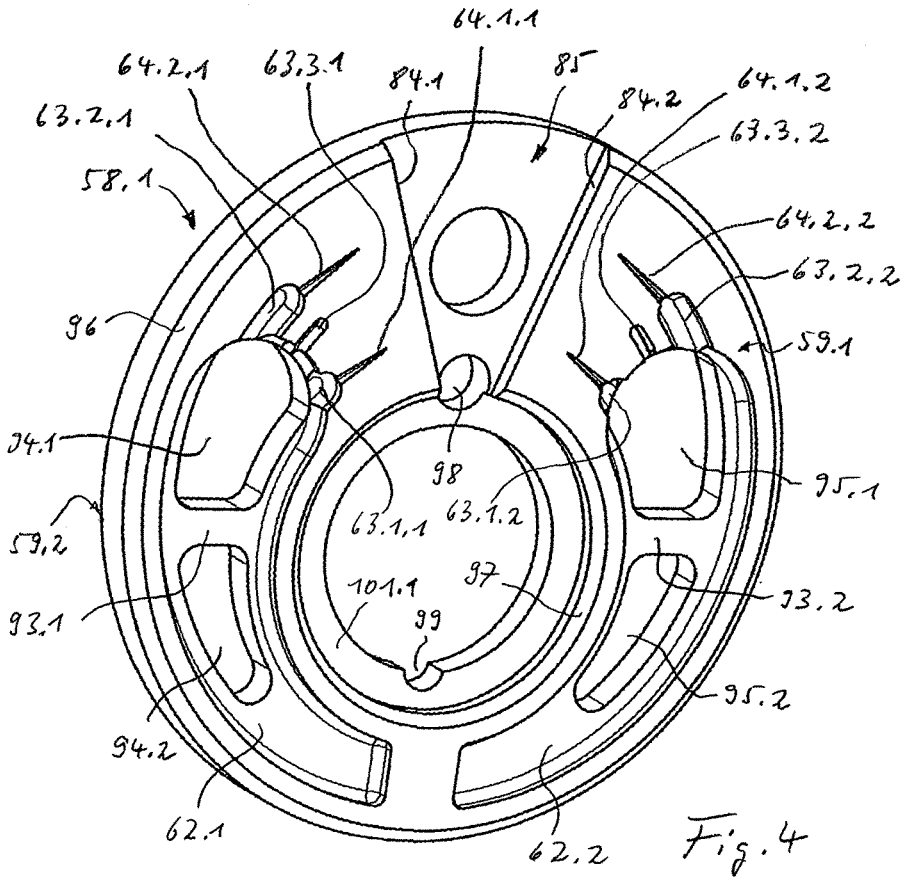
FIG. 4 shows a perspective view of an axial sealing plate of the internal gear machine.
Figure 5:
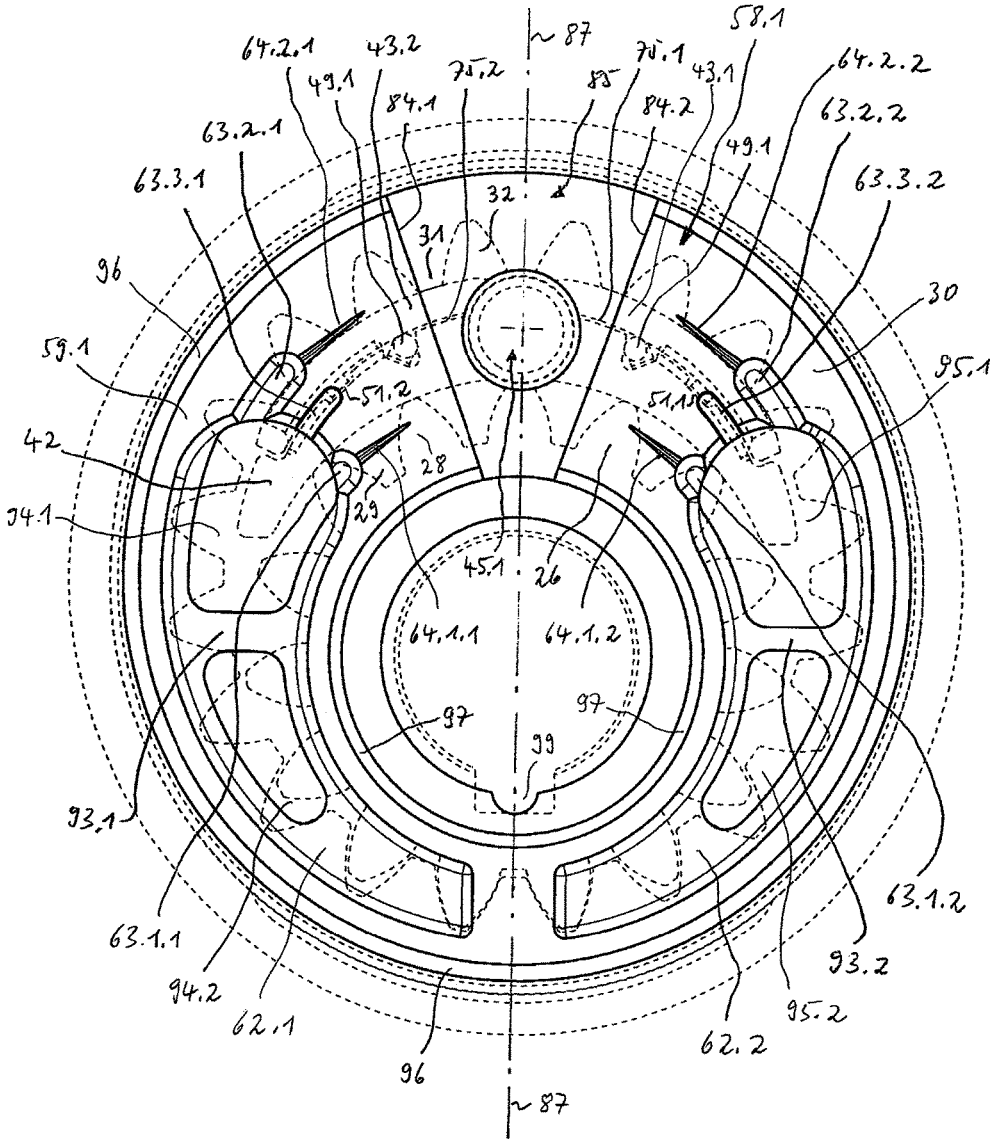
FIG. 5 shows a plan view of the axial sealing plate according to FIG. 4, wherein the machine elements are indicated with dotted lines according to the view of FIG. 3, in order to illustrate the position and arrangement of elements with respect to one another.
Figure 6:
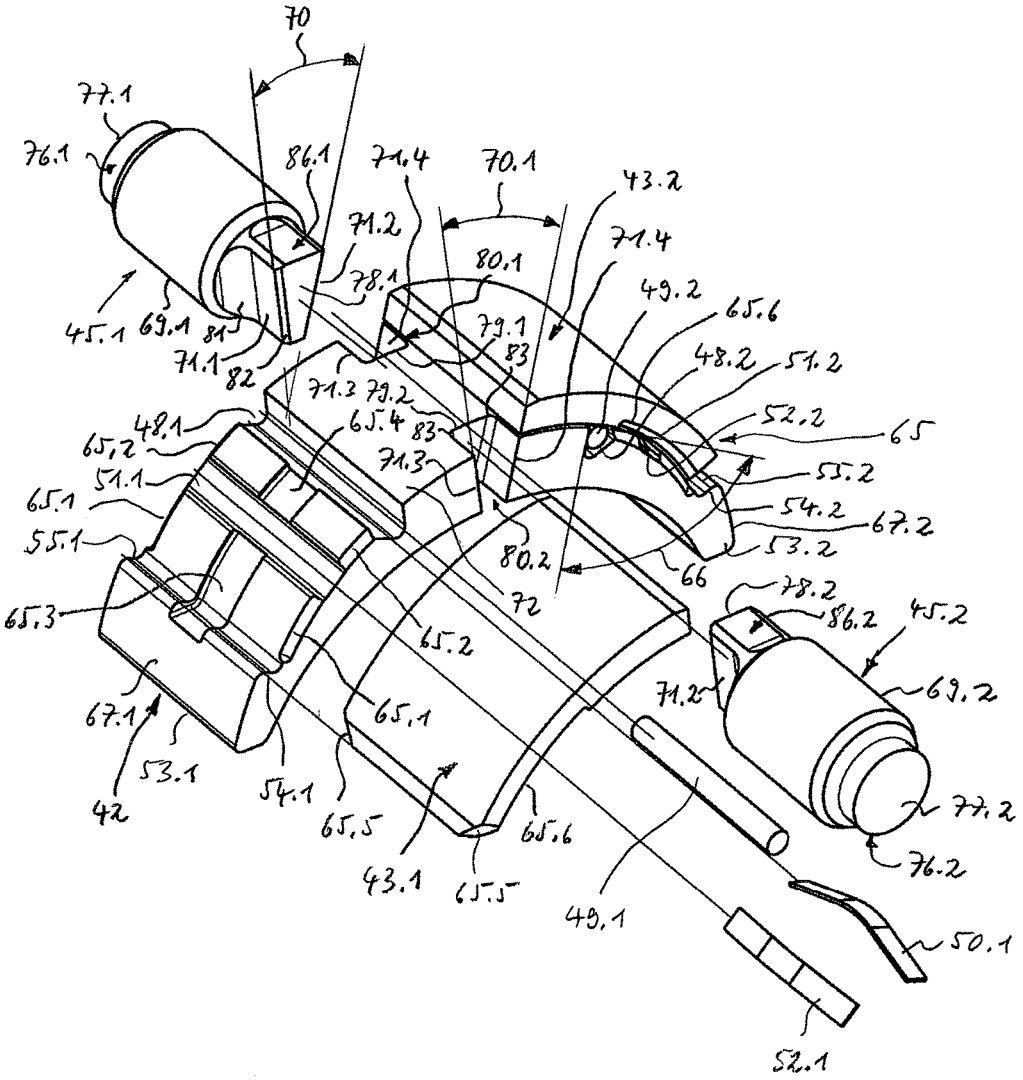
FIG. 6 shows a perspective view of the structural components that form and support the filler element in an exploded view.

The axial washers 58.1, 58.2 have pocket-shaped control fields 62.1, 62.2, which can also be called sealing plates recesses or pressure pockets (see FIGS. 4 and 5), on their inner sides 59.1, 60.1, thus the sides which are allocated to the pinion 26 and the hollow gear 30. These are recesses or indentations in the particular axial washer 58.1, 58.2. These control fields 62.1, 62.2, just as the pressure fields 61.1, 61.2, can be pressurized with pressurizing medium under high pressure or pressurized with pressurizing medium of the respective high pressure area 44.1, 44.2 during operation of the internal gear machine 21. A counteracting force, which counteracts the force of the pressure fields 61.1, 61.2, is produced in this way. At least two control grooves 63.1.1, 63.1.2; 63.2.1, 63.2.2, which are open to the allocated faces 56.1, 56.2; 57.1, 57.2 of the gears 26, 30, are allocated to each pressure pocket 62.1, 62.2, of which a first control groove 63.1.1, 63.1.2 is arranged directly opposite thereto in the area of the pinion tooth gaps 29 formed between the pinion teeth 28 of the pinion 26 and of which a second control groove 63.2.1, 63.2.2 is arranged directly opposite thereto in the area of the pinion tooth gaps 32 formed between the hollow gear teeth 31 of the hollow gear 30 (refer to FIG. 5). Both the first control groove 63.1.1, 63.1.2 as well as the second control groove 63.2.1, 63.2.2 ends with a first end in the allocated pressure pocket 62.1, 62.2. A control slot 64.1.1, 64.1.2; 62.2.2, 64.2.2 in the form of a recess or indentation of the particular axial washer 58.1, 58.2 is provided in a respective second end of the first and second control groove 63.1.1, 63.1.2; 63.2.1, 63.2.2 that faces away from the first end in peripheral direction. Each control slot 64.1.1, 64.1.2; 62.2.1, 64.2.2 ends in the respectively allocated first or second control groove 63.1.1, 63.1.2; 63.2.1, 63.2.2. Each control slot 64.1.1, 64.1.2; 62.2.1, 64.2.2 extends approximately or substantially in peripheral direction.

In addition to the above features, the inventive motor pump unit 20 or the inventive internal gear machine 21 has the following inventive features, among others:

The at least one axial sealing plate 58.1, 58.2 has at least one sealing plate indentation or recess 63.3.1, 63.3.2 that is open to the faces 56.1, 56.2; 57.1, 57.2 of the gears 26, 30 in the form of a conventional or third sealing plate control channel that pressurized with pressurizing medium, which is configured as a sealing plate control groove on its side facing to the faces 56.1, 56.2; 57.1, 57.2 of the gears 26, 30 or inner side 59.1, 60.1. This is a third control channel of three control channels in the shown preferred exemplary embodiment, which in each case ends in the pocket-shaped sealing plate recess that can be pressurized with pressurizing medium or the pressure pocket 62.1, 62.2 of both sealing plate recesses or pressure pocket 62.1, 62.2 of each axial washer 58.1, 58.2. Said additional or third sealing plate control channel 63.3.1, 63.3.2 is open to the allocated radial gap 75.1, 75.2 and is directly opposite to the allocated radial gap 75.1, 75.2 (refer to FIG. 5). The respective additional or third sealing plate control channel 63.3.1, 63.3.2 extends from the respective sealing plate recess or pressure pocket 62.1, 62.2 in peripheral direction along the allocated radial gap 75.1, 75.2 between the pinion segment 42 and the allocated hollow gear segment 43.1, 43.2 into an area which lies directly opposite to the segment spring groove 51.1, 51.2. Said additional sealing plate control channel 63.3.1, 63.3.2 has no control slot, in contrast to the particular first and second control grooves 63.1.1, 63.1.2; 63.2.1, 63.2.2. The necessary radial compensation pressure in the allocated radial gap 75.1, 75.2 is achieved between the pinion segment 42 and the respectively active hollow gear segment 43.1, 43.2 almost simultaneously and an especially advantageous seal is therefore achieved by means of the particular additional sealing plate control channel or by means of the particular third control groove 63.3.1, 63.3.2.

According to the invention it is additionally provided for the internal gear machine 21 that the pinion segment 42 and/or the hollow gear segment 43.1, 43.2 have at least one radial sealing segment depression in the form of a radial sealing segment control channel 65; 65.1, 65.2, 65.3, 65.4, 65.5, 65.6, which can be pressurized with the pressurizing medium, which extends in peripheral direction around the pinion rotational axis 34.2 or around the pinion rotational axis 36, which control channel is open to the allocated radial gap 75.1, 75.2 and empties directly into the allocated radial gap 75.1, 75.2. The radial sealing segment control channel 65 preferably extends in a direction or in rotational direction in which the pinion 26 can be rotated around its pinion rotational axis 34.2 or in which the hollow gear 30 can be rotated around its pinion rotational axis (36) and/or the radial sealing segment control channel 65 extends in the direction of an imaginary plane running vertically to the axial direction 39. The pressurizing medium that builds up in the active pressure area 44.1, 44.2, preferably hydraulic fluid, can arrive more quickly in the space of the active radial gap 75.1, 75.2 by means of the above measures. The necessary radial compensation pressure is achieved in the active radial gap 75.1, 75.2 between the pinion element 42 and the respective active hollow gear segment 43.1, 43.2 in an even shorter time with the respective rotational direction reversal, and an even better or optimal seal is thus achieved.

Further measures or features, which have proven especially advantageous for the above-named operating purpose, are provided in the internal gear machine 21 according to the invention, in addition to the above features. The demands placed on this motor pump unit 20 can thus be especially met in this way:

Gearing:

The low noise and low pulsation requirement is met by means of an especially designed involute gearing with 15 teeth 28 on the pinion 26 and 20 teeth 31 on the hollow gear 30. A higher tooth number would achieve a further reduction in the flow pulsation, but would at the same time also increase the diameter of the hollow gear. This would imply more installation space and a reduction in the hydraulic-mechanical efficiency of the gear machine. The manufacturing costs would additionally increase. The mass moment of inertia of the gear pump would additionally increase as a result of the larger hollow gear diameter. A low mass moment of inertia is decisive, however, for the energy efficiency of the motor pump unit 20 with high dynamic demands of up to 10 rotational direction changes per second.

Both the externally toothed pinion 26 as well as the internally toothed hollow gear 30 are profile shifted gears. The engagement angle amounts to 25°. The tooth head height factor of the pinion teeth amounts to 1.25 and the tooth head height factor of the hollow gear teeth amounts to 1.24. This combination has proven to be extremely low in noise. The tooth head edges are especially shaped.

A slight flank play (0.02 to 0.05 mm or 0.01 to 0.025× modulus) ensures that even with highly dynamic reverse operation, only very little pressurizing medium, in particular hydraulic fluid, can flow over the tooth engagement area to the "suction side."

Radial Compensation:

The radial compensation is symmetrically presented by three segment portions 42; 43.1, 43.2, also called radial sealing segments. The one-piece pinion segment 42 actively seals in both rotational directions, both during pump and motor operation. The two hollow gear segments 43.1, 43.2 only actively seal in the corresponding rotational direction. The inactive sealing segment 43.1, 43.2 is held in position by a spring element 52.1, 52.2. The seal between the radial sealing segments 42; 43.1, 43.2, thus between the pinion segment 42 and the particular hollow gear segment 43.1, 43.2, is ensured by the bilaterally arranged sealing rollers 49.1, 49.2. The sealing rollers 49.1, 49.2 are made from a robust temperature-resistant plastic. The sealing rollers 49.1, 49.2 are received in suitable recesses 48.1, 48.2 of the pinion segment 42. The sealing rollers 49.1, 49.2 are pressed under fluid-pressure in the internal gear machine 21 against a sealing surface of the pinion segment 42 and against a sealing surface of the respective active hollow gear segment 43.1, 43.2. In pressure-free state, the sealing rollers 49.1, 49.2 are pressed by the respective sealing roller springs 50.1, 50.2 against the sealing surfaces. The sealing surfaces are arranged at a special angle 66, which is less than 110°. The pressure force of the sealing rollers 49.1, 49.2 in this way also achieves a radial "spread" of the radial sealing segments 42; 43.1, 43.2 and thus an abutment of the radial sealing segments 42; 43.1, 43.2 against the tooth heads of the teeth 28, 31 of the pinion 26 and the hollow gear 30.

Hydraulic control is exercised via the radial gap 75.1, 75.2 between the peripheral surface 43, also called inner surface, of the pinion segment 42 and the respective inner peripheral surface 44.1, 44.2, also called 0 inner surface, of the respective hollow gear segment 43.1, 43.2. At least one additional control groove 63.3.1, 63.3.2 is mounted in at least one axial sealing plate, preferably in the axial sealing plates 58.1, 58.2, for a secure actuation. The pressurizing medium or pilot oil cannot only arrive via the radial gap 75.1, 75.2 between the radial sealing segments 42; 43.1, 43.2 in the corresponding space, but also via the faces or on the face side in the gap between the segments 42; 43.1, 43.2 through this at least one additional control groove 63.3.1, 63.3.2. This "dual" actuation has shown to be extremely effective in especially preventing a drop in conveyance, in particular with the dynamic demands during reverse operation of the internal gear machine 21. In other words: The necessary radial compensatory pressure in the gap 75.1, 75.2 between the segments 42; 43.1, 43.2, and therefore an optimal radial sealing, is hereby achieved almost "simultaneously" with the reversal in direction of rotation.

Other optimizations are possible by means of chamfers 65.1, 65.2, 65.5, 65.6 and/or grooves 65.3, 65.4 on the pinion segment 42 and/or on the hollow gear segments 43.1, 43.2. The chamfers 65.1, 65.2, 65.5, 65.6 can be advantageously installed on both sides, but also on one side of the segments 42; 43.1, 43.2. The pressurizing medium or pressure oil building up in the pressure chamber can arrive faster in the space, that is, in the gap or compensation chamber formed by means of the radial gap 75.1, 75.2 between the pinion 26 and the active hollow gear segment 43.1, 43.2 up to the respective sealing roller 49.1, 49.2, through these chamfers 65.1, 65.2, 65.5, 65.6. These chamfers 65.1, 65.2 can be arranged, as described, between the segment spring groove 51.1 and the sealing roller groove 48.1 and/or from the segment spring groove 51.1 up to the stop pocket or up to the stop 54.1 at the segment carrier 42 and/or over the entire stop surface 55.1 up to the free surface 67.1.

Pressurizing medium or pressure oil can then directly or indirectly flow into the gap or compensation chamber 75.1, 75.2 via these chamfers 65.1, 65.2. As described, these chamfers 65.5, 65.6 can alternatively or additionally also be installed on the hollow gear segments 43.1, 43.2. The same tasks can also be assumed by control grooves 65.3, 65.4 at the outer periphery of the pinion segment 42 and/or the inner periphery of the hollow gear segments.

The filler element 41 is supported by two retaining pins or bolts 45.1, 45.2, which are rotatably mounted via corresponding bores 68.1, 68.2 in the housing parts 25.1, 25.2 in the shown exemplary embodiment. The retaining pins or bolts 45.1, 45.2 have a perfectly cylindrical guiding area, 69.1, 69.2, that spans an outer diameter over a guiding length. The guiding length preferably amounts to 1.5× outer diameter of the guiding area 69.1, 69.2. The retaining pins or bolts 45.1, 45.2 are produced from sintered material, preferably from sintered iron, with a corresponding strength due to costs reasons. The inner diameter of the bores 68.1, 68.2 of the housing parts 25.1, 25.2 is greater by a few micrometers than the outer diameter of the guiding area 69.1, 69.2 of the retaining pins or bolts 45.1, 45.2. A play adaptation is obtained in this way. The retaining pins or bolts 45.1, 45.2 can thus rotate during operation of the internal gear machine 21 and the abutment faces 71.1, 71.2, which preferably enclose an angle 70 of 24°, can rotate in a position that is optimal for the sealing function of the segments 42; 43.1, 43.2. Because the guiding length amounts to 1.5× outer diameter, the surface pressure is reduced, on the one hand, and an impermissible tilting of the respective retaining pin or bolt 45.1, 45.2 in the receiving bore 68.1, 68.2 of the respective housing part 25.1, 25.2 is prevented, on the other hand. A wear protection coating on the outer diameter of the respective retaining pin or bolt 45.1, 45.2 increases the service life of the gear machine 21, in particular during highly dynamic load and change of the direction of rotation as well as dynamic switchover between motor and pump operation. This wear protection is attained by means of a surface hardening, such as nitration or carbonitration with corresponding material selection due to cost reasons.

The respective retaining pin or bolt 45.1, 45.2 has a perfectly cylindrical step 76.1, 76.2 on its side that faces away from the abutment faces 71.1, 71.2 arranged in V shape. The step 76.1, 76.2 has a clearly smaller outer diameter in comparison to the guiding area 69.1, 69.2. The face 77.1, 77.2 of the step 76.1, 76.2 is applied on the bore base of the bore in the housing part 25.1, 25.2 and forms in this way an axial stop of the retaining pins or bolts 45.1, 45.2 in direction of the concerned housing part 25.1, 25.2. The axial shiftability of the retaining pin or bolt 45.1, 45.2 in direction of the radial sealing segments 42; 43.1, 43.2 between the abutment faces 71.1, 71.2 and the groove base 79.1, 79.1 of the segment grooves 80.1, 80.2 of the pinion segment 42 is limited by means of a face 78.1, 78.2. The retaining pin or bolt 45.1, 45.2 must basically have axial play, but should also or nevertheless not collide with the teeth 28, 31 of the pinion 26 or the hollow gear 30. Free surfaces are also installed for this purpose. Said step 76.1, 76.2 allows a cost effective production of the bores 68.1, 68.2 in the housing parts 25.1, 25.2, for example, by using a reamer with a relatively large cutting chamfer. This means that the bore 68.1, 68.2 does not have to have the fit diameter up to the bore base. The largest possible radii 81 are fitted at the transition of the abutment faces 71.1, 71.2 to the fit diameter in order to increase the endurance limit of the retaining pin or bolt 45.1, 45.2 and therefore the security and service life of the hydraulic machine 21. Chamfers 82 on the segment side face 77.1, 77.2 of the respective retaining pin or bolt 45.1, 45.2 also allow radii 83 of the grooves 80.1, 80.2 of the pinion segment 42 intended for support on the retaining pin or bolt 45.1, 45.2 on the groove base 79.1, 79.2. These radii 81, 83 reduce the notch stress at the segments 42; 43.1, 43.2, which are preferably made from special brass or sintered material, without limiting the mobility of the segments 42; 43.1, 43.2 as a result of jamming.

The pressure buildup in the teeth gaps 29, 32 of the pinion 26 and hollow gear 30 is controlled by means of control grooves 63.1.1, 63.1.2; 63.2.1, 62.2.2 and control slots 64.1.1, 64.1.2; 64.2.1, 64.2.2 introduced through the respective axial washer 58.1, 58.2. These are optimized in their position as well as the cross sectional areas in particular of the control slots 64.1.1, 64.1.2; 64.2.1, 64.2.2 with a triangular V-shaped cross section preferably with a V-angle of 60° and an angle of inclination preferably within the range of 4°, so that a radial compensating effect of the pinion segment 42 and the respectively active hollow gear segment 43.1, 43.2, which is nearly optimal at all operating points, is obtained in interaction with the location and position of the segments 42; 43.1, 43.2, in particular the sealing roller position and the angle 70 of the abutment faces and support surfaces 71.1, 71.2; 73.1, 73.2 of the retaining pin 45.1, 45.2 or the pinion segment grooves 80.1, 80.2 as well as the location and position in particular of the two lateral faces 84.1, 84.2 of the V-shaped free surface 85 in the axial washers 58.1, 58.2, optimal in almost all operating points radial compensation effect of the sprocket segment 42 and the respective active hollow gear segments 43.1, 0.43.2 results. The control grooves 63.1.1, 63.1.2; 63.2.1, 62.2.2 have a direct connection to the respective pressure pocket 62.1, 62.2 of the respective axial sealing washer 58.1, 58.2 and are thus directly pressurized with pressurizing medium or pressure oil during the operation of the internal gear machine 21. Control slots 64.1.1, 64.1.2; 64.2.1, 64.2.2, control grooves 63.1.1, 63.1.2; 63.2.1, 62.2.2; 63.3.1, 63.3.2 and pressure pockets 62.1, 62.2 are arranged at both sides of the gearing mechanism. Unilateral solutions in which the cross sections are correspondingly adapted are however also conceivable.

The retention of the segments 42; 43.1, 43.2 is achieved radially outwardly by means of the engagement of the respective retaining pins 45.1, 45.2 in the corresponding grooves 80.1, 80.2 in the pinion segment 42 and by means of a radial transfer of the retaining pin 45.1, 45.2 beyond the pinion segment 42. The position of the segments 42; 43.1, 43.2 is thus also form lockingly provided in the non-pressurized state. The grooves 80.1, 80.2 of the pinion segment 42 must be slightly larger or wider than the part 86.1, 86.2 of the respective retaining pin 45.1, 45.2, which is also called retaining element and projects into the grooves 80.1, 80.2, in order to ensure the mobility or the shiftability with the segments 42; 43.1, 43.2 in the previously described advantageous V-shaped embodiment of the abutment faces 71.1, 71.2 of the retaining pin or bolt 45.1, 45.2. The play must be selected according to the gear mechanism tolerances of the housing parts 25.1, 25.2, segments 42; 43.1, 43.2, bearing bushings as well as the deformation under load, and taking into consideration the thermal expansion of the components within the temperature range of the application: A play of between 0.05 and 0.1× module of the gear tooth system of the displacement device has shown to be advantageous. A jamming of the gear tooth system as a result of the wedge-shaped segments 42; 43.1, 43.2 is prevented in this way also in the non-pressurized operation.

Axial Compensation:

The preferably bilateral axial compensation can be achieved by means of inherent pressure, just like the radial compensation. The axial compensation is achieved via axial plates 58.1, 58.2 controlled by axial pressure fields 61.1, 61.2, which are symmetrical to a symmetry plane containing the rotational axes of the pinion 26 and the hollow gear 30. This symmetry plane 87 runs through the center point 88 of the rotational axis 34.2 of the pinion 26 and the center point 89 of the rotational axis 36 of the hollow gear 30 in a cross section that is perpendicular to the axial direction 39 or the rotational axes 34.2, 36 when observed from the cross section running from the pinion 26 and hollow gear 30. This symmetry applies for the respective axial washer 58.1, 58.2 as well as also for the axial pressure spring 61.1, 61.2 installed in the preferably pot-shaped housing part 25.2 and/or in the housing part 25.1, which is preferably configured as a cover.

The sealing of the axial pressure fields 61.1, 61.2 preferably takes place by means of axial seals 90 with support rings 91 (refer to FIGS. 8 to 10). The axial seal would have to be completely "locular" in axial seals without supporting rings with this highly dynamic reversibly used hydraulic machine. This means that the groove would have to additionally have a "rim" "inwardly" toward the pressure field in order to accommodate the seal. This necessary "rim" would make difficult the production of the housing or cover parts. The pressure field 61.1, 61.2 can be entirely produced in pocket shape with the supporting ring 91. The base of the pressure fields 61.1, 61.2 must not be completely mechanically processed, but can be produced, for example, with pressure die cast parts or other die cast parts by means of the casting process.

The supporting ring 91 has in addition the advantage that it prevents a gap extrusion of the axial seal 90 into the gap between the axial plate 58.1, 58.2 and the housing or top wall. The hydraulic machine 21 can hereby also be used for higher pressures. A gap extrusion of the axial seal would furthermore cause a minor enlargement of the active axial pressure field and would as a result increase the compensation force. This would in turn lead to a reduction of the hydraulic-mechanical efficiency and would therefore worsen the energy efficiency of the motor pump unit. A malfunction of the hydraulic machine could occur in the worst case as a result of a seal failure or an increased wear of the running surfaces of the axial washer on the side of the gear mechanism.

The "inward" supporting effect of the supporting rings 91 is considerably improved by means of one or several bridges 92. The arrangement of these bridges 92 must be selected in such a way that the oil flow particularly to the axial pressure output or also the oil flow from the inlet is not affected. The bridge 92 is located precisely in the same position as a bridge 93.1, 93.2 that is arranged in the pressure pocket 62.1, 62.2 of the respective axial washer 58.1, 58.2 in the shown example. The axial compensation is optimally adjusted in the described example by means of the provisions that will be described in the following. The pressure pockets 62.1, 62.2 arranged symmetrically to the symmetry plane 87, whose boundary radii project, on the one hand, over the tooth base radius of the pinion gear tooth system and, on the other hand, over the tooth base radius of the hollow gear tooth system, ensure a constant counteracting force. The occurrence of changing compensation forces as a consequence of changing pressures between the faces 56.1, 56.2; 57.1, 57.2 of the teeth 28, 31 and the axial washer 58.1, 58.2, which would result in the axial plate without these pressure pockets, is prevented in this way in this area. An exact adaptation of the axial compensation is achieved by means of a calculated and empirical determination and specification of the discharge diameter of the pinion 26 and hollow gear 30. The or each axial washer 58.1, 58.2 preferably has two breakthroughs 94.1, 95.1; 94.2, 95.2. The pressurizing medium flows through these breakthroughs 94.1, 95.1; 94.2, 95.2 from the input side to the pressure pocket 62.1, 62.2 and inversely from the pressure pocket 62.1, 62.2 over the pressure fields 61.1, 61.2 to the pressure output. Each bridge 93.1, 93.2 is located in the exemplary embodiment at approximately the height of the pinion center and has a cross section dimensioned in such a way that approximately 50% of the hydraulic force produced by the operating pressure in the pressure pocket 62.1, 62.2 and the breakthroughs 94.1, 95.1; 94.2, 95.2 is absorbed. Transition radii at the breakthroughs reduce the notch stress and consequently increase the permissible operating pressures or increase the service life of the hydraulic machine 21. The or each axial washer 58.1, 58.2 is usually produced from brass or aluminum, but can also be produced by means of a sintering process or by means of metal powder injection molding (MIM technology). A correspondingly minimized friction coating is advantageously applied to reduce friction.

Figure 2:
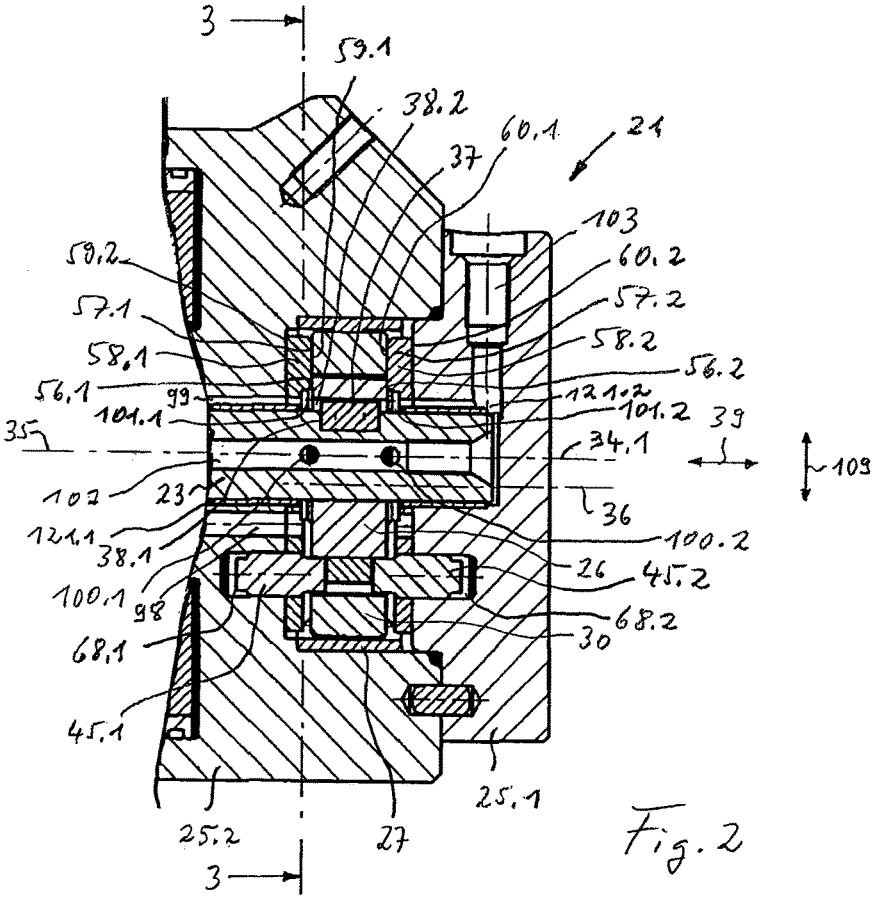
FIG. 2 shows a longitudinal section of a section of the internal gear machine in the area of the motor pump unit within a section plane which contains the pinion rotational axis of the pinion and the hollow gear rotational axis of the hollow gear.
Figure 11:
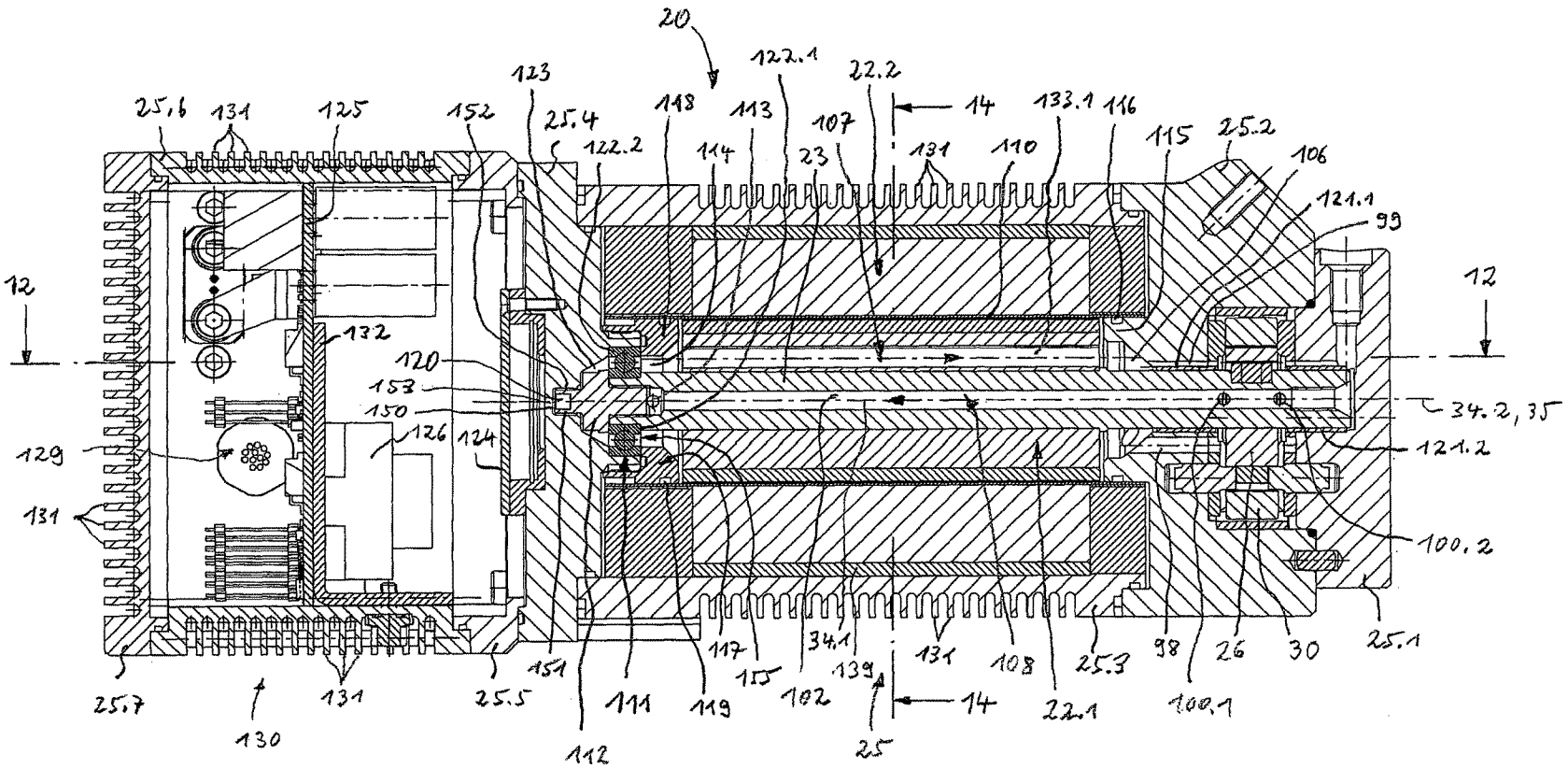
FIG. 11 shows a longitudinal section of the motor pump unit in a section plane that contains the pinion rotational axis of the pinion and the hollow gear rotational axis of hollow gear.

The radial expansion of the pressures is achieved, as was described previously, by means of the control grooves 63.1.1, 63.1.2; 63.2.1, 63.2.2; 63.3.1, 63.3.2 and the control slots 64.1.1, 64.1.2; 64.2.1, 64.2.2 as well as by means of the V-shaped free surface 85 and at the tooth engagement 33 by means of the sealing along the engagement line. The fixation of the respective axial plate 58.1, 58.2 takes place, on the one hand, by means of the projection of the bearing bushings that support the shaft 23 on the inner diameter as well as retaining pins or bolts 45.1, 45.2 on the through bore on the outer periphery of the respective retaining pin or bolt 45.1, 45.2. The respective axial plate 58.1, 58.2 is freely movable within the provided axial play in axial direction 39. The leakage oil originating over the axial washer or plate 58.1, 58.2 as well as the leakage oil originating over the sealing roller 49.1 49.2 collects in the area of the V-shaped free surface 85 as well as in the annular space, which is formed by means of the chamfer 96 of the respective axial sealing washer 58.1, 58.2 on the hollow gear 30 and in the annular space 101.1, 101.2 also called leakage channel, which is formed with the chamfer 97 of the respective axial sealing washer 58.1, 58.2 on the pinion 26. This leakage oil is guided in part via a bore 98 as well as a groove 99 in the connecting space 106. A large or basic part of the total leakage oil flows via radial bores 100.1, 100.2 into the shaft (pump motor shaft) 23 arranged in the area of the respective annular space 101.1, 101.2, and a central, axially installed discharge bore 102 of the shaft 23, also called shaft leakage channel (refer to FIGS. 2, 11 and 12). It is understood that the bore 98 and/or the groove 99 can also be omitted. In this latest case, the total leakage oil would flow via the radial bores 100.1, 100.2 of the shaft 23 into the shaft leakage channel 102. The flow speed or discharge of leakage oil in the can chamber 107 or the leakage channel loop 108 could be maximized as a result. With "can chamber" 107 is designated the room located in the interior or inside the sealing tube or can 110 seen in radial direction 109, which is radially outwardly delimited by the sealing tube or can 110.

An even better heat dissipation could be achieved by means of the aforementioned provisions. A still better lubrication of the motor mount 111 could be achieved at the same time. An overall even longer service life or malfunction-free operation of the motor pump unit 20 could be achieved thereby. A venting screw 103 for filling and venting the complete hydraulic system is installed in the pump cover 25.1. The discharge bore 102 is sealed by means of a bearing mounting screw 112, also called a sealing means, in the area of the radial ball bearing 111 arranged in the motor flange 25.4 and ends in a radially installed bore 113. This radial bore 113 ends in an annular space 114, which is also called a connecting chamber.

Overall Design the Motor Pump Unit:

The requirement of absolute tightness can only be achieved by means of a hermetically sealed system. There are three possibilities to attain this:

1. Magnetic coupling between pump and motor
2. Canned motor—motor submerged in oil
3. Complete motor submerged in oil with pressure resistant current feedthrough The magnetic clutch is eliminated due to reasons related to space and costs. A special motor 22 with a sealing tube, also called a "can" 110, was developed for the preferred application of the motor pump unit 20. The designation "can" stems from the fact that this tube 110 is arranged between the rotor 22.1 and the stator 22.2. The sealing tube or can 110 is made from non-magnetic material, preferably high temperature-resistant, pressure-resistant, fiber-reinforced plastic. The sealing tube 110 extends almost over the full length of the stator packet and is encapsulated in plastic with the stator 22.2, including the coil and the motor housing 25.3, forming a unit. The cover or housing part 25.2 projects with a corresponding centering collar 115 with O-ring groove 116 into the sealing tube or can 110 on the side of the sealing tube or can 110 that faces toward the pinion. A bearing mounting screw 117 with a corresponding centering collar 118 with O-ring groove 119 which is bolted to the motor flange or housing part 25.4 projects into the sealing tube or can 110 on the side of the sealing tube or can 110 that faces away from the pinion. O-rings accommodated in the O-ring grooves 116, 119, which are not depicted in the drawings, assume the sealing function, and thus seal the canned motor chamber 107 at least against leakage fluid on both sides of the rotor 22.1.

The mutual motor pump shaft 23 bears the pressed-on rotor 22.1, comprises pressure compensation bores and the bearing mounting or sensor screw 107 for receiving a speed sensor 120. The motor pump unit 23 is mounted only on or in the radial ball bearing 111 on the motor side and on or in at least one slide bearing, preferably on or in two slide bearings 121.1, 121.2 on the pump side. The pinion 26 of the pump or hydraulic machine 21 is mounted by means of a clearance fit on the pump motor shaft 23 and rotatably entrained by means of the slightly crowned feather key 37. The inner ring 122.1 of the ball bearing 111 is fixedly connected with the bearing mounting and sensor screw 112 to the motor pump shaft 23. The outer ring 122.1 of the ball bearing 111 is screwed with the bearing mounting screw 117 to the bearing cover or housing part 25.4 on the side of the electronics. The motor pump unit 23, and thus also the pressed-on rotor 22.1, are axially fixed in this way. The bearing cover 25.4 has an especially stepped blind hole 123, into which the bearing mounting and sensor screw 112 projects. The signal transmission takes place through the closed bearing cover or housing part 25.4, which has a wall thickness of a few millimeters in the area of the sensor 120. The wall thickness preferably amounts to about 2 mm. The electronics circuit board 124 of the speed sensor 120 is arranged on the side of the bearing cover or housing part 25.4 that faces away from the motor 22 in a housing part shaped as a flange mount 25.5 and a circuit board 125 of the motor controller, here the final stage 126, also at a specific axial distance thereto. A control circuit board is arranged on this final stage 126. The phasing lines 127 (refer to FIG. 1) of the motor 22 preferably lead through bores in the housing part or bearing cover 25.4 and are screwed or plugged into or soldered to the final stage 126. Sensor lines of temperature sensors that measure the coil temperatures of the motor 22 are similarly arranged. The connection of the motor pump unit 20 takes place via a power plug 128 as well as a signal plug 129 with small dimensions. The two plugs 128, 129 are sealingly installed on the electronics box 130. The electronics box 130 is formed by a tubular housing part 25.6 and a housing part 25.7 configured as a cover as well as the housing part 25.4 likewise called a bearing cover or motor flange. The electronics box 130 with cooling ribs 131 is likewise screwed on. Sealing elements are likewise arranged between the individual elements of the electronics box 130. The final stage 126 is assembled with heat conductive paste on a mounting angle 132 preferably made from copper. The heat development of the components is guided hereby through the copper angle 132 into the cooling ribs 131 of the tubular housing part 25.6 of the electronics box 130. The cover 25.6 of the electronics box 130 and the tubular motor housing 25.3 are likewise provided with cooling ribs 131. The intermediate housing of the hydraulic machine represents at the same time also the bearing cover 25.4 or the motor flange of the electric motor 22. The hydraulic machine is configured as a compensated 4-quadrant internal gear machine 21 and is basically fluidically connected to the interior of the sealing tube or can 110.

Figures 12, 13:
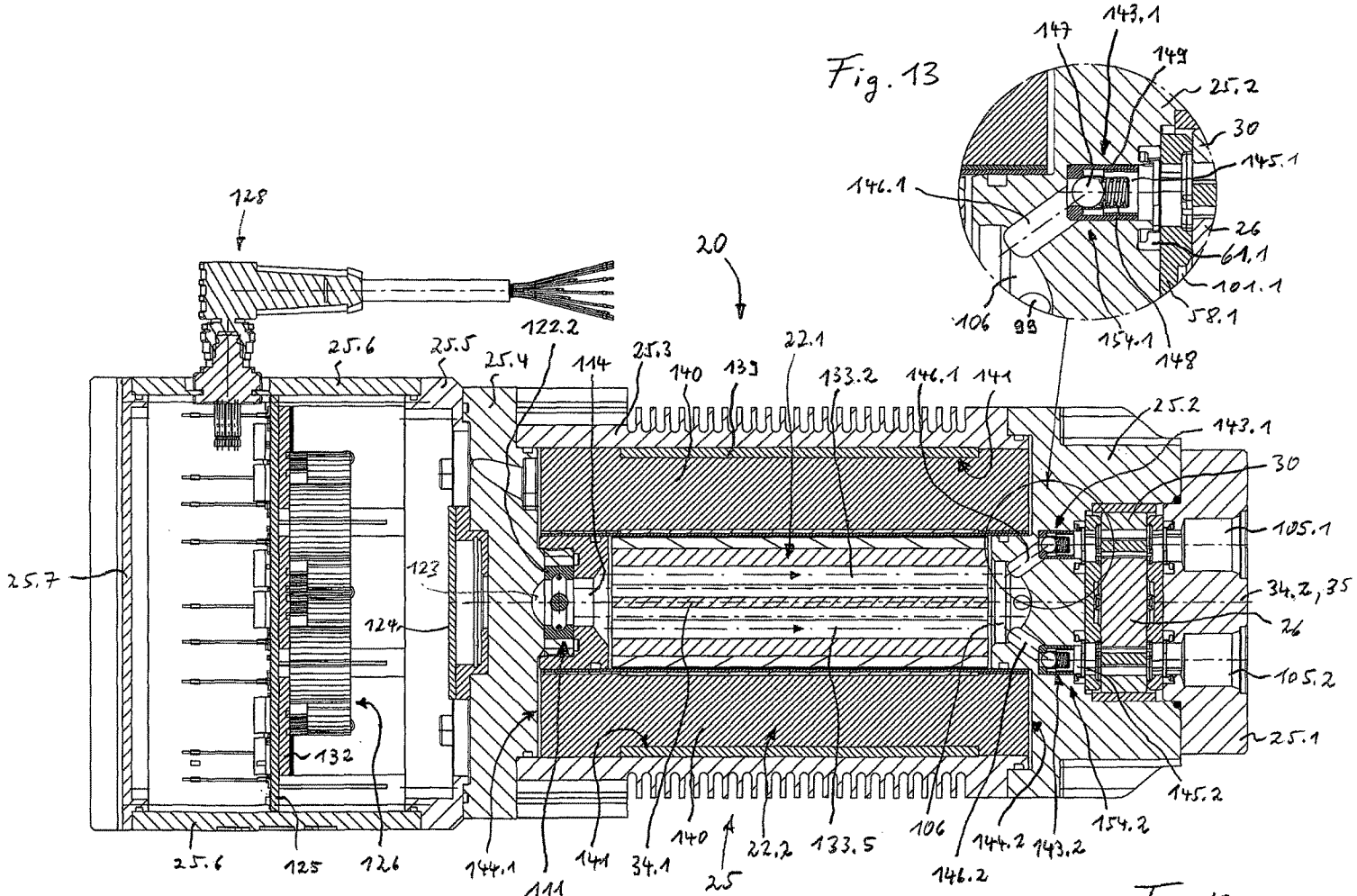
FIG. 12 shows a longitudinal section of the motor pump unit in a section plane in accordance with section lines 12-12 in FIG. 11.
FIG. 13 shows a greatly enlarged section in accordance with the circle marked in FIG. 12.
Figure 15:
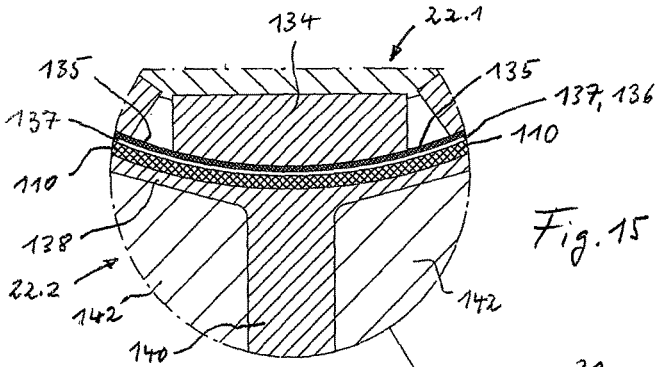
FIG. 15 shows a greatly enlarged section in accordance with the partial circle marked in FIG. 14.
Figure 14:
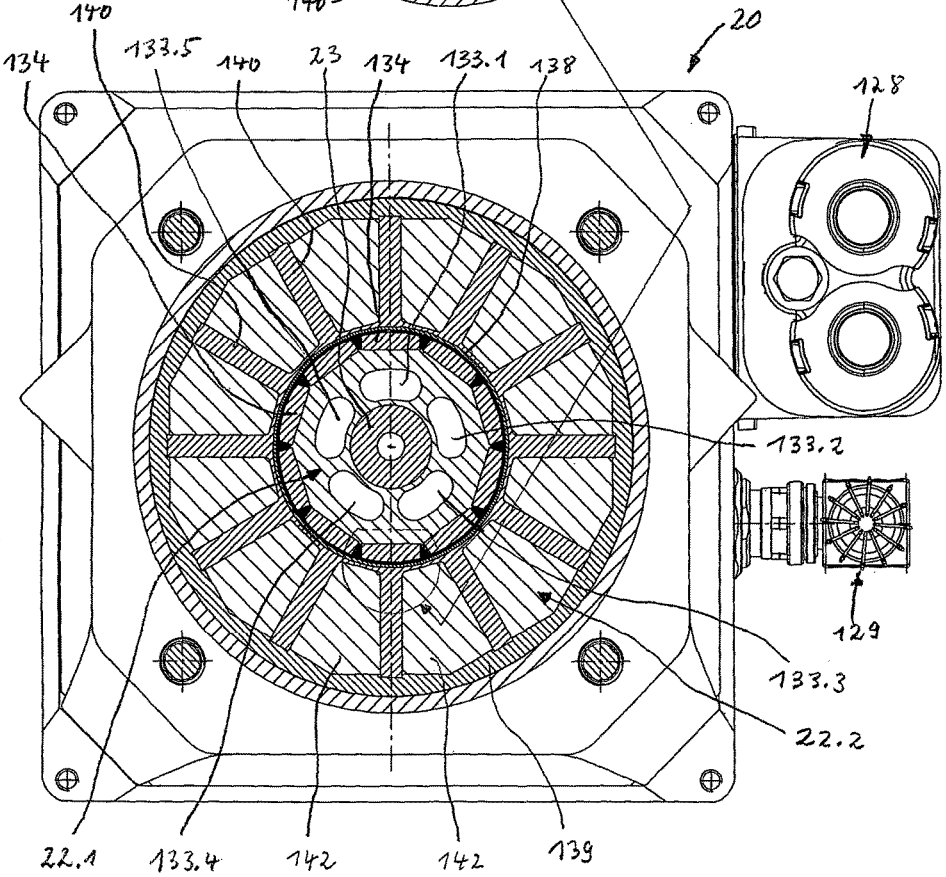
FIG. 14 shows a cross section of the motor pump unit in a cross section in accordance with section lines 14-14 in FIG. 11.

An electric motor 22 in the form of a brushless direct current motor (EC motor) has shown to be particularly advantageous especially for the application or use of the motor pump unit 20 for actuation or operation of a highly dynamic hydraulic axis. As can be seen in FIGS. 12 and 14, the rotor 22.1 of the electric motor 22 comprises a multitude of recesses 133.1, 133.2, 133.3, 133.4, 133.5, also called leakage rotor channels. These are preferably arranged mutually offset by identical peripheral angles around the rotor rotational axis 33.1 or the shaft rotational axis 35. Five leakage rotor channels 133.1, 133.2, 133.3, 133.4, 133.5 are provided in the shown exemplary embodiment. The rotor 22.1 also comprises a multitude of high performance magnets 134, preferably permanent magnets. The magnets 134 are arranged mutually offset by identical peripheral angles around the rotor rotational axis 34.1 or the shaft rotational axis 35. Ten magnets 134 are provided in the shown exemplary embodiment. As can be especially seen in FIG. 15, the magnets 134 are provided with a tubular bandage 135 on their outer surfaces that face radially outwardly away from the rotor rotational axis 34.1 or the shaft rotational axis 35. This bandage 135 delimits the rotor 22.1 radially outwardly at its outer periphery. The rotor 22.1 is rotatably mounted with respect to the stator 22.2 in a cylindrical mounting space 136 of said stator. The cam 110, which is also called sealing tube and is fixedly connected to the stator 22.2, is likewise arranged in the cylindrical mounting space 136 of the stator 22.2, but when observed in radial direction 109 between the rotor 22.1 and the stator 22.2. A narrow annular gap 137, which is also called leakage gap channel 137, is configured between the sealing tube or can 110 and the rotor 22.1 when observed in radial direction 109. This annular channel 137 extends in axial direction 39, preferably basically over the total axial length or over the total axial length of the rotor 22.1.

The stator 22.2 comprises an inner tube 138 and an outer tube 139 as well as several bridges 140 that extend in radial direction 109 between the inner tube 138 and the outer tube 139 and also in axial direction 39, which are connected at one end to the inner tube 138 and at the other end to the outer tube 139. Twelve bridges 140 are preferably provided in the shown exemplary embodiment (refer to FIG. 14). As can be seen in FIG. 12, the bridges 140 have a recess 141 at their radial outer ends, in which the outer tube 139 of the stator 22.2 is arranged. The respective recess 141 has an axial width or the outer tube 139 has an axial length that is slightly smaller than the axial length of the rotor 22.1 when observed in axial direction 39. The stator 22.2 is produced from several stator sheets. A mounting space 142 is respectively configured between neighboring bridges 140 of the bridges 140, the inner tube 138 and the outer tube 139 of the stator 22.2. Twelve mounting spaces 142 that correspond to the number of bridges 140 are thus preferably provided in the shown exemplary embodiment. Each mounting space 140 serves to accommodate stator coils of metal wires, which configure the phasing lines 127. Each mounting space 142 furthermore serves to accommodate grouting material. The stator 22.2 is accommodated in a cylindrical stator mounting space of the motor housing 25.3 of the housing 25 of the motor pump unit 20 and is fixedly connected to the motor housing 25.3.

At least one leakage channel 101.1, 101.2, which is fluidically connected to the working chamber 24 and preferably configured as an annular space, and via which the leakage oil that forms under pressure along the axial and radial sealing surfaces during operation of the internal gear pump 21 is discharged, is arranged in the housing part 25.2 of the housing parts 25.1, 25.2 of the housing 25 that delimit the working chamber 24 of the pump 21. In other words, the at least one leakage channel 101.1, 101.2 serves for the discharge of the leakage fluid consisting of fluid pressurizing medium that forms during operation of the internal gear machine 21 in particular with a radial and/or axial gap seal by means of the radial sealing segments 43.1, 43.2 and/or the at least one axial sealing plate 58.1, 58.2. The annular space 101.1, 101.2 configured in each axial sealing plate 58.1, 58.2, which is open to the working chamber 24 in axial direction 39 and to the shaft 23 in radial direction 109, functions in particular as leakage channel (refer to FIGS. 2, 4 and 11).

The shaft 23 extends with a shaft end 23.1 of its two shaft ends 23.1, 23.2 away from the pinion 26 in axial direction 39 through the rotor 22.1 supported by the shaft 23. The connecting channels 105.1, 105.2 arranged in the housing part 25.1 of the housing 25 are connected via check valves 143.1, 143.2 arranged in the housing 25 or in the housing part 25.2 of the housing 25 that delimits the working chamber 24 of the internal gear machine 21 to the leakage channel loop 108 that is fluidically connected to the at least one leakage channel 101.1, 101.2. The leakage channel loop 108 extends over the rotor end 144.1 of the rotor 22.1 that extends away from the pinion 26. The leakage channel loop 108 has the shaft leakage channel 102 that extends in axial direction 39 in the shaft 23 or through the shaft 23, also called discharge bore, and at least one leakage rotor channel 133.1, 133.2, 133.3, 133.4, 133.5 of the rotor 22.1 that is fluidically connected to shaft leakage channel 102, which extends at a radial distance from the shaft leakage channel 102 and through the rotor 22.1 in axial direction 39, and the leakage gap channel 137 that is likewise fluidically connected to the shaft leakage channel 102 is configured between the rotor 22.1 and the stator 22.2 and extends in axial direction 39 when observed in radial direction 109. The check valves 143.1, 143.2 open in fluid flow direction from the leakage channel loop 108 to the respectively active low pressure area of the working chamber 24 and lock in opposite direction or in opposite fluid flow direction from the respectively active high pressure area of the working chamber 24 to the leakage channel loop 108. It is thus achieved during operation of the internal gear pump 21 that the leakage fluid flows from the at least one leakage channel 101.1, 101.2 through the leakage channel loop 108 into the working chamber 24. The leakage fluid, that is, with the exception of a leakage flow portion that is minor in comparison with the total leakage flow, basically flows from there into the connecting channel 105.1, 105.2 allocated to the respectively active low pressure area.

It can be provided according to the invention, in other words, that the shaft leakage channel 102 that extends in axial direction 39 is arranged in the shaft 23, which is fluidically connected to the at last one leakage channel 101.1, 101.2, and that at least one leakage rotor channel 133.1, 133.2, 133.3, 133.4, 133.5 that extends in axial direction 39 through the rotor 22.1, preferably at a radial distance, in particular parallel to the shaft leakage channel 102, is arranged in the rotor 22.1, and is fluidically connected to the shaft leakage channel 102 and/or that a leakage gap channel 137 that extends in axial direction 39 when observed in radial direction 109 and configured between the rotor 22.1 and the stator 22.2 is fluidically connected to the shaft leakage channel 102, and that the shaft leakage channel 102 or the leakage rotor channel 133.1, 133.2, 133.3, 133.4, 133.5 and/or the leakage gap channel 137 is connected via a first check valve 143.1 arranged in the housing 25 or in a housing part 25.2 of the housing 25 that delimits the working chamber 25 to the first connecting channel 105.1 and via a second check valve 143.2 arranged in the housing 25 or in one or the housing part 25.2 that delimits the working chamber 24 to the second connecting channel 105.2, and that the first check valve 143.1 prevents a fluid flow of fluid pressurizing medium from the then active first high pressure area 44.1 of the working chamber 24 via the first check valve 143.1 in the shaft leakage channel 102 or in the leakage rotor channel 133.1, 133.2, 133.3, 133.4, 133.5 and/or in the leakage gap channel 137 with a rotation in the first operating direction 104.1, and the second check valve 143.2 allows a fluid flow of the leakage fluid either from the shaft leakage channel 102 or from the leakage rotor channel 133.1, 133.2, 133.3, 133.4, 133.5 and/or from the leakage gap channel 137 via the second check valve 143.2 into the then active first low pressure area 44.1 of the working chamber 24, and that the second check valve 143.2 prevents a fluid flow of fluid pressurizing medium from the then active second high pressure area 44.2 of the working chamber 24 via the second check valve 143.2 in the shaft leakage channel 102 or in the leakage rotor channel 133.1, 133.2, 133.3, 133.4, 133.5 and/or in the leakage gap channel 137 during a rotation in the second operating direction 104.2, and the first check valve 143.1 allows a fluid flow of leakage fluid either from the shaft leakage channel 102 or from the leakage rotor channel 133.1, 133.2, 133.3, 133.4, 133.5 and/or from the leakage gap channel 137 via the first check valve 143.1 into the then active second low pressure area 44.2 of the working chamber 24, so that the leakage fluid, preferably in a leakage fluid circuit, flows from the at least one leakage channel 101.1, 101.2 either through the shaft leakage channel 102 and from there through the leakage rotor channel 133.1, 133.2, 133.3, 133.4, 133.5 and/or through the leakage gap channel 137, or inversely, via the second check valve 143.2 into the then active first low pressure area 44.1 of the working chamber 24 during the rotation in the first operating direction 104.1, and the leakage fluid, preferably in a leakage fluid circuit, flows from the at least one leakage channel 101.1, 101.2 either through the shaft leakage channel 102 and from there through the leakage rotor channel 133.1, 133.2, 133.3, 133.4, 133.5 and/or through the leakage gap channel 137, or inversely, via the first check valve 143.1 into the then active second low pressure area 44.2 of the working chamber 24 during the rotation in the second operating direction 104.2.

Shuttle Valves/Check Valves:

FIG. 12 shows a longitudinal section through the gear machine 21 in the area of two arranged check valves 143.1, 143.2. The check valves 143.1, 143.2, which are also called shuttle valves, have the task of always connecting the can chamber 107 to the working connections or connecting channels 105.1 and 105.2 in such a way that a pressure that is as low as possible is present in the can chamber 107. The described motor pump unit 20 is preferably used in a closed hydraulic system that is not shown in the figures. This hydraulic system can comprise, for example, in addition to a double or single acting hydraulic cylinder, also a pressure accumulator preferably configured as a membrane pressure accumulator, which is capable of compensating or compensates for volume changes due to different piston areas as well as temperature fluctuations. The pressure accumulator ensures a specific system or preload pressure. The system or preload pressure is preferably within the range of 5 to 40 bar. The working pressure of the internal gear machine 21 is superimposed on this preload or system pressure. The working pressure can amount to up to 120 bar or also up to 250 bar or more. The shuttle valves 143.1, 143.2 have now the task of ensuring that only the lowest pressure is always present in the area of the can chamber 107. The shuttle valves 143.1, 143.2 are respectively located in an axial bore 145.1, 145.2 (refer to FIGS. 12 and 13), also called channel part of a reverse flow channel 154.1, 154.2, preferably configured as a blind bore, located in the respective pressure field 61.1, 61.2, here for example the housing part 25.2 (refer to FIGS. 7 and 13). An oblique bore 146.1, 146.2 of the respective reverse flow channel 154.1, 154.2 connects the bore base of the respective axial bore 145.1, 145.2 to the can chamber 107 via the connecting space 106 (refer to FIGS. 12 and 13). The shuttle valves 143.1, 143.2 are conventional spring loaded check valves with a ball 147 as sealing and locking element and a spring 148, by means of which the ball 147 is prestressed in its sealing and locking position. The ball 147 and the spring 148 are mounted in a guiding element 149. The guiding element 149 is pressed into the respective axial bore 145.1, 145.2 and secured with a safety sleeve. A higher pressure is now produced in one of the pressure fields 61.1, 61.2 depending on the direction of rotation 104.1, 104.2. This closes the sealing or locking element (ball) 147 of one of the exchange valves 143.1, 143.2 associated with this pressure field 61.1, 61.2. The shuttle valve 143.1 allocated to the pressure field 61.1 that is then pressurized with high fluid pressure consequently closes with an operating direction in the first direction of rotation 104.1 and the shuttle valve 143.2 allocated to the pressure field 61.2 that is then pressurized with high fluid pressure consequently closes with an operating direction in the second direction of rotation 104.2.

Leakage oil is produced under pressure in the preferably axially and radially compensated internal gear machine 21 along the axial and radial sealing surfaces. This leakage oil collects in the free surfaces 85 and annular spaces 96, 101.1, 101.2, in particular in the axial washers 58.1, 58.2 (refer to FIG. 4). The leakage oil flows through the radial bores 38.1, 38.2 in the motor pump shaft 23 (refer to FIGS. 2 and 11), which are fluidically connected to the at least one annular space 101.1, 101.2, into the axial discharge bore 102 in the pump shaft 23, also called shaft leakage channel, and from the latter again via the radial bore 113 and via the recesses 133.1, 133.2, 133.3, 133.4, 133.5, also called leakage rotor channels, into the rotor 22.1 or via the annular gap, also called leakage gap channel 137, between the rotor 22.1 and the stator 22.1, concretely between the bandage 135 of the rotor 22.1 and the can 110, which is also called sealing tube and is fixedly connected to the stator 22.2, back into the connecting space 106. Taking into consideration the preferably very small gap width of this annular gap or leakage gap channel 137 and the multitude of recesses 133.1, 133.2, 133.3, 133.4, 133.5 of the rotor 22.1, also called leakage rotor channels, which also have a comparatively large passage cross section, the largest portion or an important portion of the total leakage oil flows back into the connecting space 106 through the leakage rotor channels 133.1, 133.2, 133.3, 133.4, 133.5. A slight overpressure is produced in this way in the connecting space 106, which in the end opens the shuttle valve 143.1, 143.2 in the low pressure-loaded pressure field 61.1, 61.2 depending on the direction of rotation 104.1, 104.2. A connection between the input side, that is, the system or preload pressure, and the can chamber 107 is produced by means of the open shuttle valve 143.1, 143.2. The preload pressure or system pressure can be lower by several multiples than the working pressure. The stator 22.2 of the motor pump unit 20 and also the two cover or housing parts 25.2, 25.4 can be advantageously cost effectively configured by means of this advantageous arrangement according to the invention of the shuttle valves 143.1, 143.2, since these components do not have to withstand the high working pressure.

It is also ensured by means of the above-described leakage oil guide that the ball bearing 111 arranged on the motor side is supplied with oil. This bearing 111 is lubricated thereby, the frictional heat is dissipated, and the service life is thus considerably increased. The radial bore 113 ends ahead of the ball bearing 111 at the ball bearing side when observed from the pinion 26 in the shown exemplary embodiment, but is fluidically connected to the bearing gap 155 formed between the inner ring 122.1 and the outer ring 122.2 of the ball bearing 111 (refer to FIGS. 11 and 12), so that a sufficient lubrication as well as also a cooling effect is still achieved and the frictional heat is still dissipated. An improvement of the bearing lubrication could be achieved by means of an axial bore, which is not shown in the drawings, as well as an additional radial bore, which is likewise not shown in the drawings, in the bearing mounting screw or sensor screw. These additional bores can be installed in the motor pump shaft 23 in addition or alternatively to, also instead of, the radial bore 113 arranged ahead of the bearing 111 or the bearing mounting screw or sensor screw 112 when observed from the pinion 26. An advantageous forced lubrication of the bearing 111 can be achieved thereby.

Joint Shaft:

A motor pump shaft 23 designed as one piece or produced from one piece is represented in the preferred exemplary embodiment shown in the figures. Separate shafts in the form of a pump shaft and a motor shaft can also be provided according to an alternative solution, which is not shown in the figures. An entrainment could take place by means of a spline, for example with a head or foot centering, in order to fix the two shafts. A fixation of the two shafts could also take place via an additional fit between motor and pump shaft. In order to maintain the leakage oil circuit as described before, the motor shaft as well as also the pump shaft would then have to have an axial shaft leakage channel or an axial discharge bore, which would have to be mutually fluidically connected.

Bearing Mounting and Sensor Screw:

The bearing mounting and sensor screw 112 is preferably made from non-magnetic material so as not to influence the magnetic signals of the sensor 120. The sensor 120 is mounted, preferably glued, in an axial bore 150 of the bearing mounting and sensor screw 112. The outer diameter of the bearing mounting and sensor screw 112 is greater than the inner diameter of the ball bearing 111 or its inner ring 122.1. An axial fixation of the ball bearing 111 or the motor pump shaft 23 on the ball bearing 111 takes place herewith. The sensor screw 112 is stepped at its outer diameter and encloses the sensor 120 with a thin-walled tubular part 151. This tubular part 151 with sensor 120 projects into a blind bore 152 in the housing or cover part 25.4. The base of the blind bore 152 has a residual wall thickness of a few millimeters, preferably of about 2 mm. The motor pump unit 20 can be pressurized with a high system pressure, preferably of up to 200 bar, by means of this advantageous embodiment of the housing or cover part 25.4. The low residual wall thickness of the base or wall part 153 of the tubular part 151 of the bearing mounting and sensor screw 112 that contains the sensor 120 exerts only a limited influence on the magnetic flow of the sensor 120. The bore 150 in the housing or cover part 25.4 is preferably only slightly larger than the outer diameter of the tubular part 151 of the bearing mounting and sensor screw 112. The surface of the base or wall part 153 of the tubular part 151 that has the low residual thickness pressurized with pressure is ideally kept as small as possible thereby.

What is claimed is:

1. A motor pump unit comprising:

a multi-part housing comprising first, second, and third housing parts;

an internal gear machine configured to operate as an internal gear pump;

a shaft rotatably mounted in the multi-part housing;

an electric motor coupled to the internal gear machine via the shaft, the electric motor comprising a rotor and a stator;

wherein the internal gear machine comprises:

a working chamber delimited by at least the first and second housing parts;

a pinion gear rotatably mounted in the working chamber, the pinion gear having a plurality of pinion teeth;

a hollow gear arranged in the working chamber, wherein the hollow gear is rotatably and eccentrically mounted relative to the pinion gear and has a plurality of hollow gear teeth, at least some of which mesh in an engagement area with at least some of the plurality of pinion teeth of the pinion gear;

a leakage channel loop fluidically connected to the working chamber via a connecting space in the second housing part;

first and second connection channels fluidically connected to the working chamber, each channel being further fluidically connected to the leakage channel loop via check valves fluidically connected to the working chamber and the leakage channel loop; and at least one leakage channel fluidically connected to the working chamber and the leakage channel loop and arranged to discharge a leakage fluid that builds up during operation of the internal gear machine;

wherein the leakage channel loop comprises a shaft leakage channel that extends in an axial direction through the shaft and at least one further leakage channel fluidically connected to the shaft leakage channel, wherein the at least one further leakage channel is a rotor leakage channel that extends in the axial direction through the rotor or a gap leakage channel that is formed between the rotor and the stator, when viewed in a radial direction, and which extends in the axial direction, and wherein the check valves open in a fluid flow direction from the leakage channel loop to the working chamber and close in an opposite direction to permit the leakage fluid to flow from the at least one leakage channel through the leakage channel loop into the working chamber during operation of the internal gear machine.

2. The motor pump unit according to claim 1, wherein:

the at least one leakage channel is directly fluidically connected to the shaft leakage channel of the leakage channel loop, and the at least one further leakage channel of the leakage channel loop is directly fluidically connected to the connecting space arranged in the second housing part to permit the leakage fluid to flow during operation of the internal gear machine from the at least one leakage channel through the shaft leakage channel and through the at least one further leakage channel to the connecting space.

3. The motor pump unit according to claim 1, further comprising:

a first return flow channel and a second return flow channel, the first and second return flow channels being arranged in the second housing part between the working chamber and the connecting space, wherein:

the first and second return flow channels each comprise a first end in the connecting space and a second end in the working chamber;

the first return flow channel comprises a first check valve and the second return flow channel comprises a second check valve to permit, during operation of the internal gear machine, the leakage fluid to flow through the leakage channel loop in and through the connecting space and from the connecting space:

in and through the first return flow channel via the first check valve into the working chamber, or in and through the second return flow channel via the second check valve into the working chamber.

4. The motor pump unit according to claim 3, further comprising:

a first channel part of the first return flow channel ending in the working chamber, wherein the first channel part and the first connection channel extend in the axial direction, and a second channel part of the second return flow channel ending in the working chamber, wherein the second channel part and the second connection channel extend in the axial direction.

5. The motor pump unit according to claim 1, wherein the rotor and the shaft each have a rotational axis, and wherein the shaft leakage channel is an axial bore with a bore longitudinal axis arranged to be coaxial to the rotor rotational axis or coaxial to the shaft rotational axis.

6. The motor pump unit according to claim 1, wherein the pinion gear and the shaft each have a rotational axis, and wherein the at least one further leakage channel is an axial recess comprising a recess longitudinal axis arranged in parallel to the pinion gear rotational axis or in parallel to the shaft rotational axis.

7. The motor pump unit according to claim 1, wherein the at least one further leakage channel comprises a plurality of rotor leakage channels that extend through the rotor in the axial direction, each of the rotor leakage channels being fluidically connected at one end to the shaft leakage channel and at the other end to the working chamber or to the connecting space.

8. The motor pump unit according to claim 1, wherein the rotor leakage channel extends through the rotor and is open to rotor ends of the rotor that face away from one another in the axial direction of the rotor.

9. The motor pump unit according to claim 1, wherein the shaft comprises at least one radial recess, and wherein the at least one radial recess:

ends at one end of the shaft leakage channel, is arranged radially outwardly open at the other end of the shaft leakage channel, and is arranged in the area of the at least one leakage channel that is open to the shaft in order to receive the leakage fluid to permit the leakage fluid to flow from the at least one leakage channel into the shaft leakage channel during operation of the internal gear machine.

10. The motor pump unit according to claim 1, wherein:

the shaft is rotatably mounted in an area of its shaft end allocated to the rotor, and the shaft leakage channel of the shaft and the rotor leakage channel of the rotor is fluidically connected to a bearing gap of a rotor bearing to permit the leakage fluid to flow to the bearing gap of the rotor bearing or through the bearing gap of the rotor bearing during operation of the internal gear machine.

11. The motor pump unit according to claim 10, wherein the rotor bearing is a roller bearing or a ball bearing.

12. The motor pump unit according to claim 11, wherein the shaft comprises at least one radial recess arranged in an area of the rotor bearing, wherein the at least one radial recess:

ends at one end in the shaft leakage channel and is radially outwardly open at the other end to a first connecting chamber fluidically connected to the bearing gap of the rotor bearing, and is fluidically connected to the at least one further leakage channel to permit the leakage fluid to flow during operation of the internal gear machine from the shaft leakage channel into the first connecting chamber that is fluidically connected to the bearing gap of the rotor bearing, and from there into the rotor leakage channel.

13. The motor pump unit according to claim 12, further comprising a bearing mounting element mounted on the shaft in the area of its shaft end allocated to the rotor, the rotor bearing being mounted on the shaft via the bearing mounting element, and comprising a sensor.

14. The motor pump unit according to claim 13, wherein the shaft leakage channel is releasably sealed by the bearing mounting element in the area of the shaft end of the shaft allocated to the rotor.

15. The motor pump unit according to claim 14, wherein the bearing mounting element is a bearing mounting and sensor screw screwed with the shaft.

16. The motor pump unit according to claim 15, wherein the bearing mounting element comprises non-magnetic material and the sensor generates magnetic signals.

17. The motor pump unit according to claim 16, further comprising:

an axial recess fluidically connected to the shaft leakage channel, wherein the axial recess:

is arranged in the bearing mounting element, ends in a radial recess of the bearing mounting element, is radially outwardly open to an annular area that is fluidically connected to the bearing gap of the rotor bearing, and wherein the annular area is arranged on a side of the rotor bearing that faces away from the pinion gear to permit the leakage fluid to flow during operation of the internal gear machine from the shaft leakage channel via the axial recess and the radial recess of the bearing mounting element, and via the annular area through the bearing gap of the rotor bearing into the rotor leakage channel.

18. The motor pump unit according to claim 1, further comprising:

a sealing tube comprising a non-magnetic material and arranged between the rotor and the stator, extending in the axial direction substantially over the entire length of the stator, and being sealingly connected to the stator to prevent penetration of the leakage fluid.

19. The motor pump unit according to claim 18, wherein the stator has coils, and wherein the sealing tube is:

encapsulated with the stator, including its coils, and the third housing part accommodates the stator, and sealed, using a non-magnetic sealing compound, as a unit against the penetration of the leakage fluid.

20. The motor pump unit according to claim 19, wherein:

the gap leakage channel is configured between the sealing tube and the rotor when viewed in the radial direction; and the shaft is a motor pump shaft comprising a single piece on which the rotor and the pinion gear are torque-proof mounted.

* * * * *